US008528899B2

(12) United States Patent
Suzuki

(10) Patent No.: US 8,528,899 B2
(45) Date of Patent: Sep. 10, 2013

(54) SHEET DETECTING APPARATUS AND IMAGE FORMING APPARATUS

(75) Inventor: Yohei Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/339,744

(22) Filed: Dec. 29, 2011

(65) Prior Publication Data

US 2012/0181741 A1 Jul. 19, 2012

(30) Foreign Application Priority Data

Jan. 13, 2011 (JP) ..... 2011-004918

(51) Int. Cl.
*B65H 9/04* (2006.01)
*B65H 9/06* (2006.01)

(52) U.S. Cl.
CPC ..... *B65H 9/06* (2013.01)
USPC ..... 271/245; 271/243; 271/244

(58) Field of Classification Search
USPC ..... 271/243, 244, 245, 265.01, 110
See application file for complete search history.

(56) References Cited

U.S. PATENT DOCUMENTS 5,153,655 A 10/1992 Suzuki et al.
5,157,444 A 10/1992 Mori et al.
5,923,140 A * 7/1999 Azumi et al. ..... 318/640
6,011,948 A 1/2000 Amano et al.
6,113,093 A 9/2000 Morinaga et al.
7,641,184 B2 1/2010 Terashima et al.
8,172,227 B2 * 5/2012 Furusawa et al. ..... 271/265.01
2005/0133992 A1 * 6/2005 Ueng et al. ..... 271/902
2005/0189709 A1 * 9/2005 Bokelman et al. ..... 271/265.01
2007/0075484 A1 * 4/2007 Terada ..... 271/258.01
2007/0284812 A1 * 12/2007 Hirai ..... 271/265.01
2010/0148426 A1 6/2010 Saito et al.
2011/0285078 A1 * 11/2011 Andoh et al. ..... 271/265.01

FOREIGN PATENT DOCUMENTS

EP 0 782 967 B1 6/2002

OTHER PUBLICATIONS

U.S. Appl. No. 13/252,303, filed Oct. 4, 2011, Yohei Suzuki.
U.S. Appl. No. 13/339,775, filed Dec. 29, 2011, Yohei Suzuki.
U.S. Appl. No. 13/410,495, filed Mar. 3, 2012, Kenji Watanabe et al.

* cited by examiner

*Primary Examiner* — Kaitlin Joerger
(74) *Attorney, Agent, or Firm* — Fitzpatrick, Cella, Harper & Scinto

(57) ABSTRACT

A sheet detecting apparatus that detects a sheet has a lever member; a biasing portion that biases the lever member for a first position where the abutting surface abuts against the leading end of the sheet; a supporting mechanism that movably supports the lever member to move in an order of the first position, a second position, and a third position, while keeping a abutting surface of lever member facing upstream; an interlocking portion that interlocks with the lever member; and a detector that detects a position of the interlocking portion. The second position is a position to which the lever member moves by the sheet being conveyed against the biasing force of the biasing member, and the third position is a position where the abutting surface is positioned upstream in the sheet conveying direction of a position of the abutting surface at the second position and where the lever member abuts the surface of the sheet being conveyed and stands by to move to the first position when a trailing end of the sheet passes the lever member.

22 Claims, 33 Drawing Sheets

SHEET DETECTING APPARATUS AND IMAGE FORMING APPARATUS

BACKGROUND OF THE INVENTION

1. Field of the Invention

The present invention relates to a sheet detecting apparatus for detecting the sheet conveyed and an image forming apparatus having the same.

2. Description of the Related Art

In general, a sheet conveying portion of an image forming apparatus includes a sheet detecting apparatus capable of detecting a front end position of the sheet in order to match the timing for sending the sheet to a transfer position and the timing for sending the image formed in the image forming portion to the transfer position (see U.S. Pat. No. 6,011,948).

Here, FIGS. 26 and 27A to 27C illustrate the sheet detecting apparatus of the related art. As illustrated in FIG. 26, the sheet detecting apparatus of the related art is provided on the downstream side in the sheet conveying direction of a pair of conveying rollers 618 and 619 closest to the transfer position at which the image formed in the image forming portion is transferred. The sheet detecting apparatus includes a lever member 623 that abuts on the sheet, an optical sensor 624, a light-shielding flag 625 for shielding an optical path starting from the light-emitting portion of the optical sensor 624 and ending at the light-receiving portion, and a stopper portion 626 for positioning the lever member 623 at the home position. The lever member 623 is rotatably formed by a rotational axis 627 and is adapted to return to the home position by a pressing force of a return spring 628 even when it rotates. The light-shielding flag 625 is formed integrally with the lever member 623 and rotates along with the lever member 623.

As illustrated in FIG. 27A, if a front end of the sheet S is brought into contact with the lever member 623, the lever member 623 rotates in the direction of the arrow of FIG. 27A with respect to the rotational axis 627 from the home position, and the light-shielding flag 625 blocks off the optical path of the optical sensor 624. If the optical sensor 624 detects that the optical path is blocked, the sheet detecting apparatus recognizes that the front end of the sheet S has arrived at the lever member 623. Then, the sheet S moves while being in contact with the front end of the lever member 623. If the rear end of the sheet S is separated from the lever member 623, the lever member 623 rotates in the direction of the arrow of FIG. 27C by the return spring 628 and returns to the home position. At this moment, the light-shielding flag 625 retracts from the optical path, and the light-receiving portion of the optical sensor 624 receives the light emitted from the light-emitting portion again so that the sheet detecting apparatus recognizes that the rear end of the sheet S has passed through the lever member 623.

However, in recent years, users demand still higher throughput for the image forming apparatus. In order to improve the throughput in the image forming apparatus, it is necessary to improve the conveying speed of the sheet or to shorten the distance (hereinafter, referred to as a "sheet interval") between the rear end of the preceding sheet and the front end of the subsequent sheet. Therefore, it is necessary for the sheet detecting apparatus to return the lever member 623 to the home position within a period corresponding to a short sheet interval after the preceding sheet S has passed.

Meanwhile, as the front end of the sheet S having passed a pair of conveying rollers 618 and 619 abuts on an abutting portion, the lever member 623 of the related art rotates by being pressed by the sheet S. As the rear end of sheet S is separated from the abutting portion, the lever member 623 is reversely rotated and returns to the home position. For this reason, a distance necessary as the sheet interval becomes the sum of the distances D1 and D2, in which D1 denotes a distance between the position where the rear end of the preceding sheet passes through the abutting portion of the lever member 623 and the home position where the front end of the subsequent sheet abuts on the abutting portion, and D2 denotes a distance at which the subsequent sheet is conveyed therebetween (refer to FIG. 27B).

Here, the distance D2 is set to $\Delta t \times v$, in which $\Delta t$ denotes the time taken for the lever member 623 to move by the distance D1, and v denotes the sheet conveying speed. When the lever member 623 performs a reciprocating movement, the distance D1 for returning the lever member 623 to the home position is generated, and distance D2 at which the subsequent sheet S is conveyed in the return operation is lengthened as the sheet conveying speed increases. For this reason, the sheet detecting apparatus of the related art has a problem in that the distance of sheet interval becomes longer as the conveying speed of the sheet S becomes faster. This suppresses further improvement in throughput.

In this regard, the invention provides a sheet detecting apparatus capable of improving the throughput by suppressing the sheet interval from being lengthened even when the sheet conveying speed increases and an image forming apparatus having the same.

SUMMARY OF THE INVENTION

The present invention provides a sheet detecting apparatus that detects a sheet conveyed by a conveying portion that conveys the sheet, the sheet detecting apparatus comprising: a lever member having an abutting surface that abuts against a leading end of a sheet conveyed by the conveying portion; a biasing portion that applies a biasing force to the lever member to position the lever member at a first position where the abutting surface abuts against the leading end of the sheet; a supporting mechanism that movably supports the lever member so that the lever member moves in an order of the first position, a second position to which the lever member moves by the sheet being conveyed against the biasing force of the biasing member, and a third position where the lever member abuts on a surface of the sheet being conveyed and waits in order to move to the first position when a trailing end of the sheet passes the lever member, while keeping the abutting surface facing upstream in a sheet conveying direction; an interlocking portion that interlock with the lever member; and a detector that detects a position of the interlocking portion.

According to the invention, it is possible to shorten the time between a point in time when the sheet has passed and a point in time when the lever member is positioned in the first position which is a standby position. Therefore, it is not necessary to obtain a long distance as the sheet interval is reduced, and thus possible to improve the throughput.

Further features of the present invention will become apparent from the following description of exemplary embodiments with reference to the attached drawings.

DESCRIPTION OF THE EMBODIMENTS

Hereinafter, the image forming apparatus including the sheet conveying portion according to the embodiment of the invention will be described with reference to the accompanying drawings. The image forming apparatus according to the embodiment of the invention is an image forming apparatus including a sheet conveying portion having a sheet detection function capable of detecting a position of the conveyed sheet, such as a copier, a printer, a facsimile, and a multifunction peripheral having a combination of the functions thereof. In the following embodiments, it will be described using the electrophotographic image forming apparatus that forms a toner image of four colors.

First Embodiment

Figure 1:
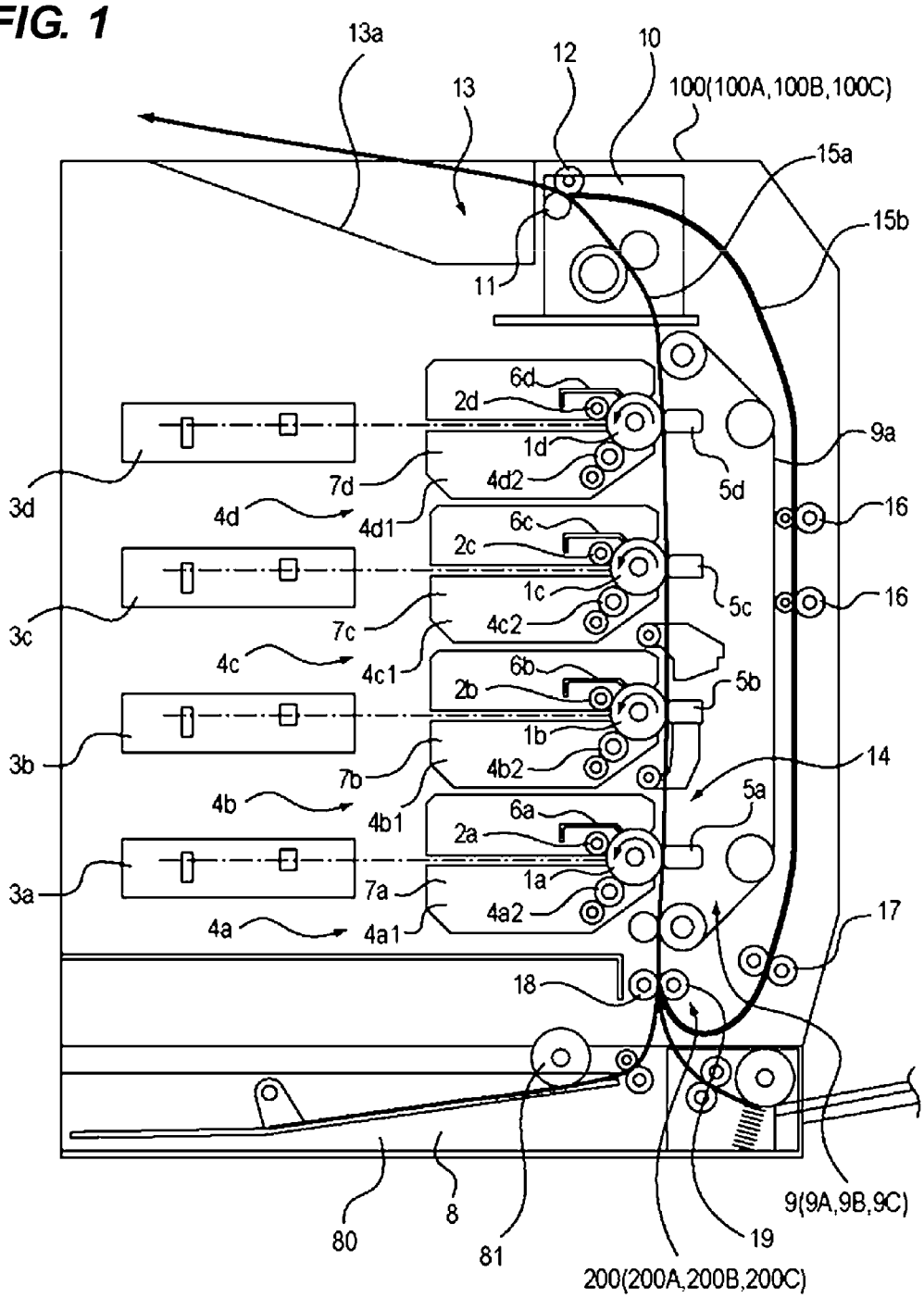
FIG. 1 is a cross-sectional view schematically illustrating the entire structure of the image forming apparatus according to a first embodiment of the invention.

The image forming apparatus 100 according to a first embodiment of the invention will be described with reference to FIGS. 1 to 10. First, the entire structure of the image forming apparatus 100 according to the first embodiment of the invention will be described with reference to the FIG. 1. FIG. 1 is a cross-sectional view schematically illustrating the entire structure of the image forming apparatus 100 according to the first embodiment of the invention.

As illustrated in FIG. 1, the image forming apparatus 100 according to the first embodiment of the invention includes a sheet feeding portion 8 that feeds the sheet S and a sheet conveying portion 9 which conveys the sheet S fed from the sheet feeding portion 8 and detects the position of the sheet S. The image forming apparatus 100 includes an image forming portion 14 that forms a toner image on the sheet S conveyed from the sheet conveying portion 9, a fixing portion 10 that fixes an unfixed toner image formed in the image forming portion 14 onto the sheet, and a sheet discharge portion 13 that discharges the sheet where the toner image is fixed.

The sheet feeding portion 8 includes a sheet cassette 80 where the sheets S are housed, a feeding roller 81 that feeds the sheets S housed in the sheet cassette 80 to the sheet conveying portion 9, and a separating portion (not illustrated) that separates the sheets S one by one. The sheet feeding portion 8 separates the sheets S housed in the sheet cassette 80 one by one and feeds the sheets S to the sheet conveying portion 9 using the feeding roller 81.

The sheet conveying portion 9 is provided on the downstream side of the sheet feeding portion 8. The sheet conveying portion 9 conveys the sheet S fed from the sheet feeding portion 8 or the sheet S conveyed from the duplex conveying path 15*b* described below. In addition, the sheet conveying portion 9 includes a sheet detector 200 as a sheet detecting apparatus for detecting that the sheet passes through a predetermined position. Moreover, the sheet detector 200 will be described in detail in conjunction with the sheet conveying portion 9 described below.

The image forming portion 14 initiates the image forming operation at a predetermined timing when the sheet detector 200 detects that the sheet S arrives at a predetermined position. Specifically, the image forming portion 14 forms the toner image based on predetermined image information at a predetermined timing and transfers the toner image onto the sheet S conveyed by the sheet conveying portion 9. The image forming portion 14 includes photosensitive drums 1*a*, 1*b*, 1*c*, and 1*d*, charging portions 2*a*, 2*b*, 2*c*, and 2*d*, exposing portions 3*a*, 3*b*, 3*c*, and 3*d*, development portions 4*a*, 4*b*, 4*c*, and 4*d*, transfer rollers 5*a*, 5*b*, 5*c*, and 5*d*, and cleaning portions 6*a*, 6*b*, 6*c*, and 6*d*. In addition, the image forming portion 14 includes a transfer belt 14*a*.

The photosensitive drums 1*a* to 1*d* serving as an image bearing member are formed by coating an organic photo conductor (OPC) layer on the outer circumferential surface of an aluminum cylinder. Both ends of photosensitive drums 1*a* to 1*d* are rotatably supported by the flanges and are rotationally driven in a counterclockwise direction in FIG. 1 by transmitting a driving force from a driving motor (not illustrated) to the one end. Charging portions 2*a* to 2*d* make the conductive roller formed in a roller shape abut on the surface of photosensitive drums 1*a* to 1*d* and uniformly charge the surfaces of photosensitive drums 1*a* to 1*d* by applying a charging bias voltage using a power supply (not illustrated). The exposing portions 3*a* to 3*d* form an electrostatic latent image on the photosensitive drums 1*a* to 1*d* by irradiating a laser beam based on image information.

The development portions 4*a* to 4*d* include toner storage portions 4*a*1, 4*b*1, 4*c*1, and 4*d*1, and developing roller portions 4*a*2, 4*b*2, 4*c*2, and 4*d*2. The toner storage portions 4*a*1 to 4*d*1 house black, cyan, magenta, and yellow toners in each color. The developing roller portions 4*a*2 to 4*d*2 are arranged adjacently to the photosensitive member surface, and the toner in each color is adhered to the electrostatic latent image on the photosensitive drums 1*a* to 1*d* by applying a developing bias voltage to develop the latent image as a toner image.

The transfer rollers 5*a* to 5*d* are arranged in the inner side of the transfer belt 14*a* so as to abut on the transfer belt 14*a* oppositely to the photosensitive drums 1*a* to 1*d*. The transfer rollers 5*a* to 5*d* are connected to the power supply for the transfer bias (not illustrated), and the positive charge from the transfer rollers 5*a* to 5*d* is applied to the sheet S through the transfer belt 14*a*. By this electric field, each negative color toner image on the photosensitive drums 1*a* to 1*d* is sequentially transferred onto the sheet S making contact with the photosensitive drums 1*a* to 1*d* so as to form the color image.

The cleaning portions 6*a* to 6*d* remove the toner remained on the surface of the photosensitive drums 1*a* to 1*d* after transferring.

In addition, according to the present embodiment, the photosensitive drums 1*a* to 1*d*, the charging portions 2*a* to 2*d*, the development portions 4*a* to 4*d*, and the cleaning portions 6*a* to 6*d* integrally constitute the process cartridge portions 7*a* to 7*d*.

The fixing portion 10 fixes the unfixed toner image by heating the sheet S where the unfixed toner image has been transferred. The sheet discharge portion 13 includes a pair of discharge rollers 11 and 12 by which the sheet S having an image is conveyed by positive rotation or is inverted by reverse rotation and a discharging portion 13*a* from which the sheet S having an image is discharged.

In addition, the image forming apparatus 100 includes a sheet conveying path 15*a* which conveys the sheet S and the like where the toner image has been formed in the image forming portion 14, a duplex conveying path 15*b*, a pair of oblique feeding rollers 16, and a pair of U-turn rollers 17. The sheet conveying path 15*a* is a conveying path for conveying the sheet S fed from the sheet feeding portion 8 or the sheet S conveyed from the duplex conveying path 15*b* and the like and is provided with the sheet conveying portion 9 and the image forming portion 14. The duplex conveying path 15*b* is a conveying path for conveying the sheet S reversed in a pair of discharge rollers 11 and 12 in order to perform duplex printing to the sheet conveying path 15*a*. A pair of oblique feeding rollers 16 is arranged in the duplex conveying path 15*b* and conveys the reversed sheet S. A pair of U-turn rollers 17 is arranged in the duplex conveying path 15*b* and re-conveys the sheet S conveyed through the duplex conveying path 15*b* to the sheet conveying path 15*a*.

The sheet S fed to the sheet conveying path 15*a* from the sheet feeding portion 8 is conveyed to the image forming portion 14 through the sheet detector 200 of the sheet conveying portion 9. In the sheet detector 200, the front end position of the sheet S is detected. As the front end position of the sheet S is detected in the sheet detector 200, the forming of the toner image (image forming operation) by the image forming portion 14 is initiated at the timing when the sheet S arrives at the transfer rollers 5*a* to 5*d*. After the toner image is formed, as the sheet S reaches the transfer roller 5*a* to 5*d*, each color of toner image on the photosensitive drums 1*a* to 1*d* is sequentially transferred onto the sheet S. Then, the unfixed toner image is fixed to the sheet S in the fixing portion 10, and the sheet S is discharged to the discharging portion 13*a* by a pair of discharge rollers 11 and 12.

In addition, at the time of duplex printing, the unfixed toner image is fixed to the sheet S in the fixing portion 10, and then, a pair of discharge rollers 11 and 12 are reversely rotated before the sheet S is discharged to the discharging portion 13*a* by the a pair of discharge rollers 11 and 12. As a result, the sheet S is conveyed to the duplex conveying path 15*b*. The sheet S conveyed to the duplex conveying path 15*b* is re-conveyed to the image forming portion 14 through the sheet detector 200 by a pair of oblique rollers 16 and a pair of U-turn rollers 17 so as to perform duplex printing.

Figure 2A:
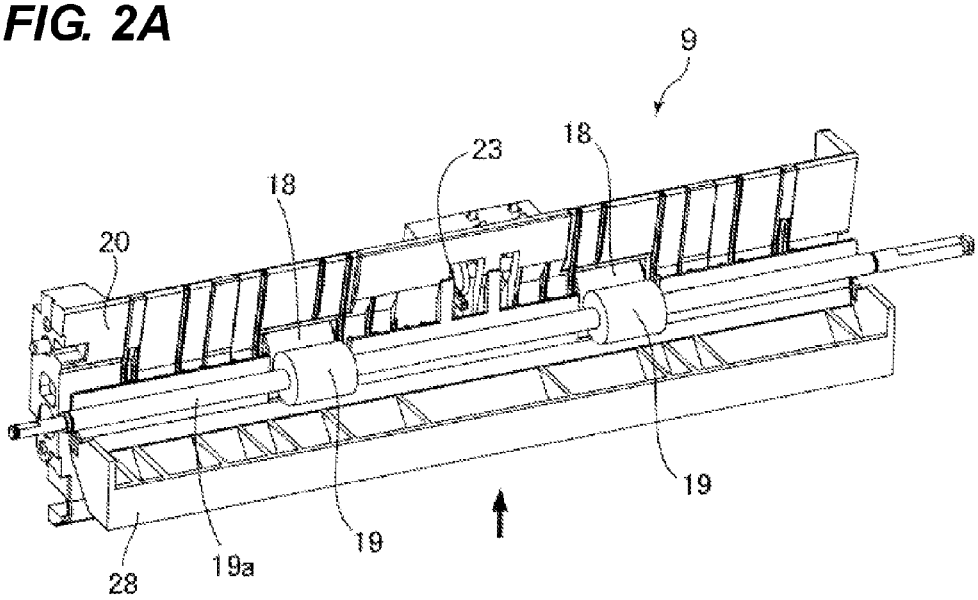
FIG. 2A is a perspective view illustrating the sheet conveying portion of the image forming apparatus according to the first embodiment of the invention.
Figure 2B:
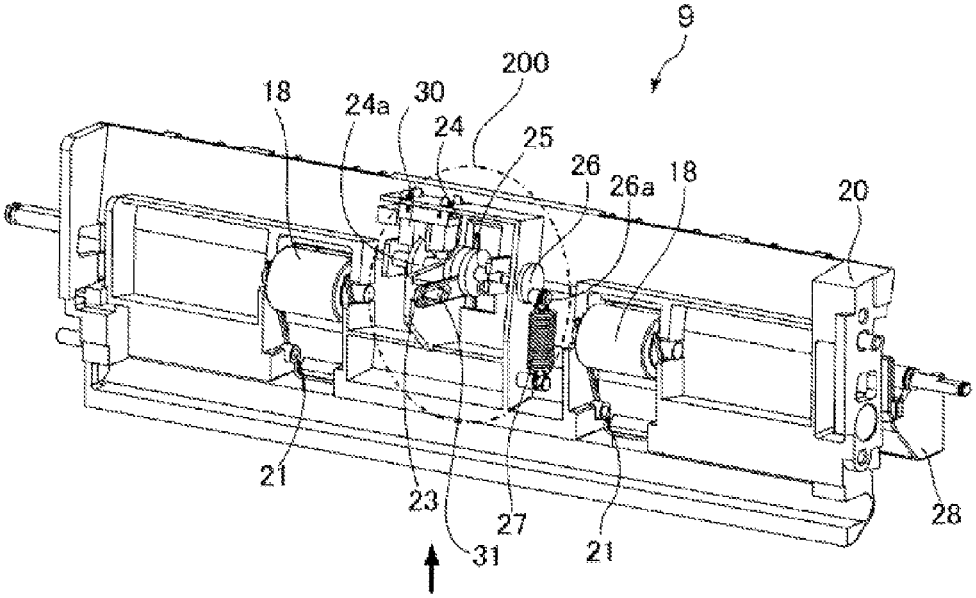
FIG. 2B is a perspective view illustrating the sheet conveying portion of FIG. 2A as seen from the opposite side.
Figure 3:
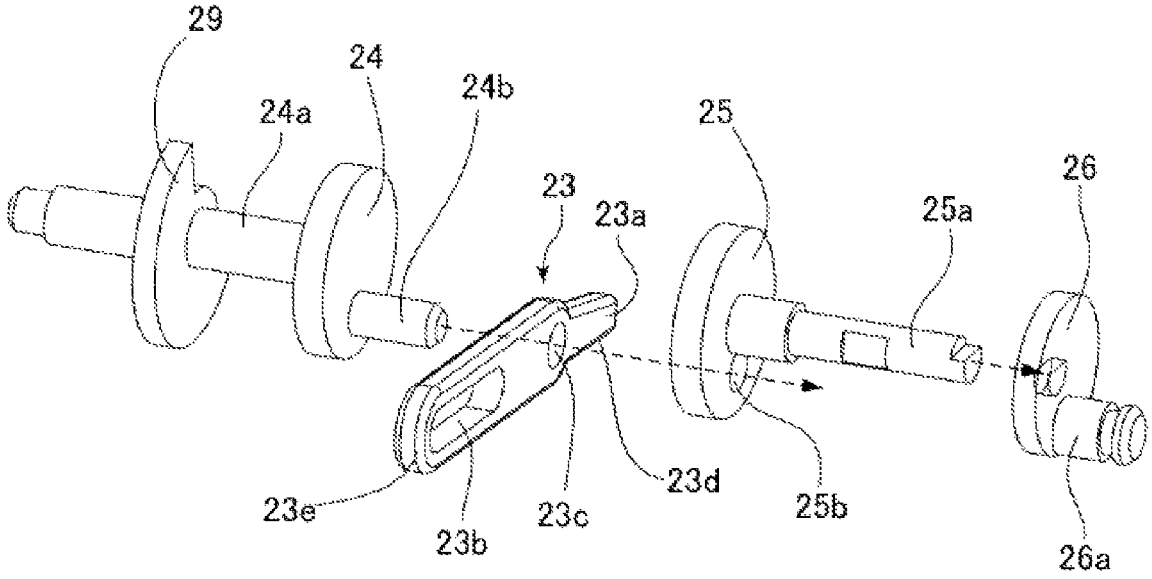
FIG. 3 is an exploded perspective view illustrating a part of the sheet detector according to the first embodiment of the invention.

Next, the sheet conveying portion 9 will be described in detail with reference to FIGS. 2A to 10. First, the entire structure of the sheet conveying portion 9 will be described with reference to FIGS. 2A to 3. FIG. 2A is a perspective view illustrating the sheet conveying portion 9 of the image forming apparatus 100 according to the first embodiment. FIG. 2B is a perspective view of the sheet conveying portion 9 of FIG. 2A as seen from the opposite side. FIG. 3 is an exploded perspective view illustrating a part of the sheet detector 200 according to the first embodiment of the invention. In addition, arrows illustrated in the FIGS. 2A and 2B represent the conveying direction of the sheet S.

As illustrated in FIGS. 2A and 2B, the sheet conveying portion 9 includes a paper feeding frame 20, a guide frame 28, a pair of conveying rollers 18 and 19 as a conveying portion for conveying the sheet S conveyed along the sheet conveying path 15*a* to the image forming portion 14, and a sheet detector 200. The paper feeding frame 20 and the guide frame 28 are arranged in the vicinity of the upstream side of the image forming portion 14 with respect to the sheet conveying path 15*a* and support a pair of conveying rollers 18 and 19 and the sheet detector 200. A pair of conveying rollers 18 and 19 includes a plurality of conveying rollers 19 and a plurality of conveying rollers 18 arranged oppositely to each of the conveying rollers 19. The conveying roller 19 is fixed to the rotational axis 19*a* axially supported in parallel with the rotational axial direction of the photosensitive drums 1*a* to 1*d* and rotates integrally with the rotational axis 19*a*. The conveying roller 18 is rotatably and axially supported by the paper feeding frame 20. In addition, the conveying roller 18 is biased to the conveying roller 19 by the conveying roller spring 21 mounted on the paper feeding frame 20 and serves as a follower rotating member of the conveying roller 19 for conveying the sheet S using this biasing force.

The sheet detector 200 is supported by the paper feeding frame 20 in the downstream side of the sheet conveying direction and the guide frame 28 from a pair of conveying rollers 18 and 19 along the sheet conveying path. The sheet detector 200 detects the front end position of the sheet S conveyed to the image forming portion 14 by a pair of conveying rollers 18 and 19. The sheet detector 200 includes a rotating lever 23 as a lever member, a support axis 31 serving as a support mechanism, a pair of rotating members 24 and 25 serving as a rotating member of a support mechanism, and rotating axes 24*a* and 25*a* which rotate a pair of rotating members 24 and 25. The support mechanism movably supports the rotating lever 23 so that rotating lever 23 can perform a crank-movement. In addition, the sheet detector 200 includes a lever driving member 26 as a connection rotating member, a bias spring 27 as a biasing member, a light-shielding flag 29 as an interlocking portion, and an optical sensor 30 as a sensor.

The rotating lever 23 includes a main portion 23*e* formed in a long plate shape (straight line shape), an abutting portion 23*a* formed integrally with the main portion 23*e* at one end of the main portion 23*e* in the longitudinal direction, and a long hole portion 23*b* formed in the other end side. In addition, the rotating lever 23 includes a connected portion 23*c* formed between the abutting portion 23*a* and the long hole portion 23*b*.

The abutting portion 23*a* includes an abutting surface 23*d* capable of abutting on the front end of the sheet S conveyed along the sheet conveying path 15*a* by a pair of conveying rollers 18 and 19. The abutting surface 23*d* is arranged to protrude to the sheet conveying path 15*a* so as to abut against the front end (leading end) of the sheet S conveyed by a pair of conveying rollers 18 and 19. Hereinafter, a position where the front end of the sheet S in the downstream side of the sheet conveying direction of a pair of conveying rollers 18 and 19 abuts on the abutting surface 23*d* is called a "first position."

The long hole portion 23*b* is formed along the longitudinal direction of the main portion 23*e* in the other end portion of the main portion 23*e*, and the fixed support axis 31 positioned in the paper feeding frame 20 is slidably engaged thereto (refer to FIG. 2B). The connected portion 23*c* is rotatably connected to a pair of rotating members 24 and 25 such that the rotating lever 23 can rotate along with a pair of rotating members 24 and 25. The support axis 31 serves as a slide support portion for supporting the main portion 23*e* of the rotating lever 23 slidably.

A pair of rotating members 24 and 25 is formed in a disk shape and rotating axes 24*a* and 25*a* is connected to each center of rotation. The rotating member 24 is provided with a connecting axis 24*b* formed to protrude as a connecting portion that can penetrate the connected portion 23*c* of the rotating lever 23 at a position (eccentric position) offset from the rotational center of the rotating member 24 to a radial direction. The rotating member 25 is provided with a connection hole 25*b* where the connecting axis 24*b* that penetrates the connected portion 23*c* can be connected. The connection hole 25*b* is formed at a position (eccentric position) offset from the rotational center of the rotating member 25 to a radial direction. A pair of rotating members 24 and 25 are connected to the rotating lever 23 by making the connection axis 24*b* be formed in an eccentric position from the rotational center penetrate the connected portion 23*c* and fit to the connection hole 25*b* formed in an eccentric position from the rotational center by insertion.

The lever driving member 26 is formed in a disk shape and is fixed to the end of the rotational axis 25*a* so as to match the rotational axis 25*a* with the rotational center of the lever driving member 26. According to the present embodiment, the lever driving member 26 is fixed to the rotational axis 25*a* by pressedly inserting the D-shaped portion formed in the front end of the rotational axis 25*a* into the D-cut hole formed in the rotational center of the lever driving member 26. The lever driving member 26 includes a connection support portion 26*a* formed to protrude in a position (eccentric position) offset from the rotational center to a radial direction. The connection supporting portion 26*a* is connected to one end of the biasing spring 27 and is provided to make the abutting surface 23*d* locate at the first position while the biasing spring 27 is at the minimum biasing state (no extending state).

One end of the biasing spring 27 is connected to the connection supporting portion 26*a* of the lever driving member 26, and the other end is fixedly positioned in the paper feeding frame 20. The biasing spring 27 applies a force to the rotating lever 23 through the lever driving member 26, the rotating axes 24*a* and 25*a*, and a pair of rotating members 24 and 25 in the upstream side of the sheet conveying direction so that the abutting surface 23*d* is located at the first position. For example, the biasing spring 27 makes the abutting portion 23*a* locate at the first position by applying a force to the rotating lever 23, rotated by a collision to the front end of the sheet, in the Z3 direction (refer to FIG. 7B described below) through the lever driving member 26.

The light-shielding flag 29 blocks the light path L of the optical sensor 30. The light-shielding flag 29 is fixed to the rotational axis 24*a* and rotates integrally with a pair of rotating members 24 and 25 with respect to the rotating axes 24*a* and 25*a*. That is, the light-shielding flag 29 interlocks with rotation of the rotating lever 23. In addition, the light-shielding flag 29 includes a slit portion 29*a* for transmitting the light of the optical sensor 30. The slit portion 29*a* is formed to transmit the light of the optical sensor 30 when the abutting surface 23*d* of the abutting portion 23*a* provided in the rotating lever 23 is located at the first position (refer to FIG. 4C described below). The light-shielding flag 29 is configured to be rotated along with the rotating lever 23 when the rotating lever 23 is pressed and rotated by the front end of the sheet S so as to block the light path L of the optical sensor 30.

The optical sensor 30 is provided in the middle of the rotating path of the light-shielding flag 29 and includes a light-emitting portion (not illustrated) that emits the light and a light-receiving portion (not illustrated) that receives the light emitted from the light-emitting portion. The light emitted from the light-emitting portion is received at the light-receiving portion so as to form the light path L. As the light-shielding flag 29 blocks the light emitted from the light-emitting portion, the signal (optical signal) output from the light-emitting portion is blocked, and the received signal is changed. The optical sensor 30 detects the movement position of the light-shielding flag 29 based on the change of the received signal.

Figure 4A:
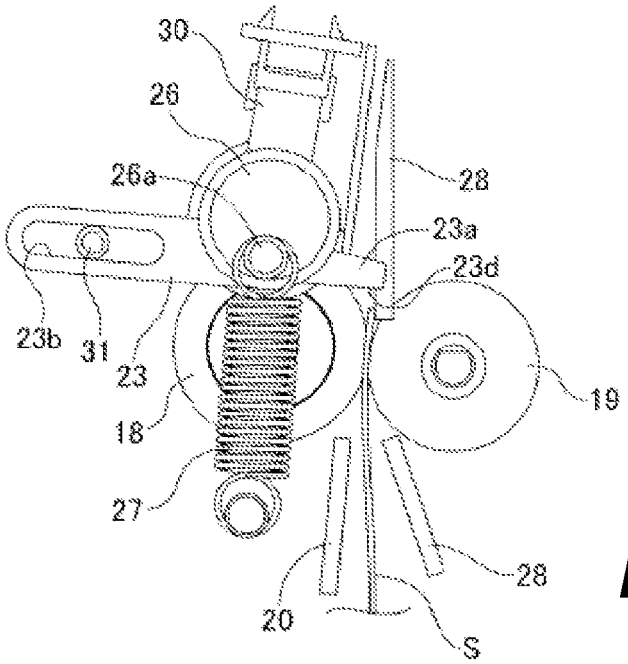
FIG. 4A is a diagram illustrating a state that the sheet is conveyed to the sheet conveying portion according to the first embodiment of the invention.
Figure 4B:
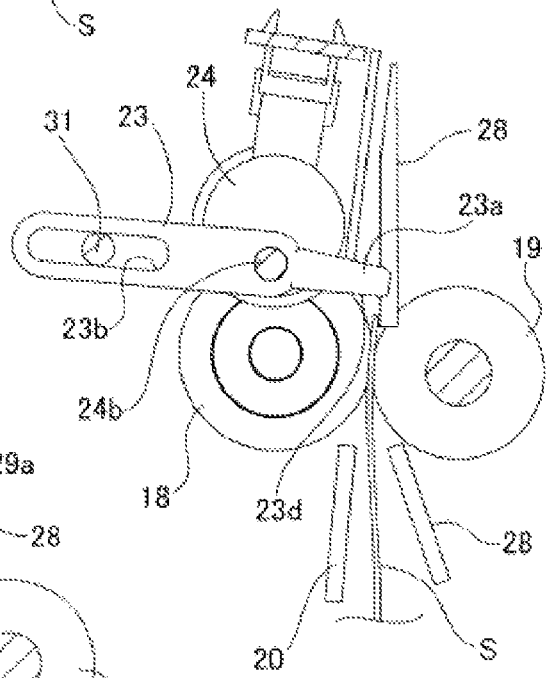
FIG. 4B is a diagram illustrating a rotating lever in a state that the sheet is conveyed to the sheet conveying portion.
Figure 4C:
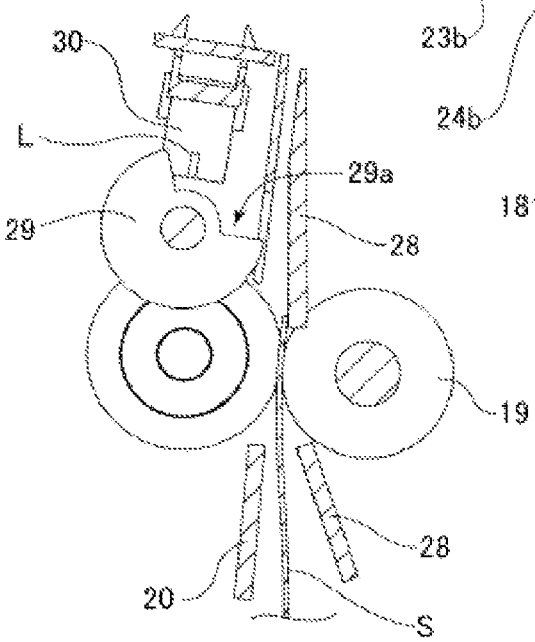
FIG. 4C is a diagram illustrating a light-shielding flag in a state that the sheet is conveyed to the sheet conveying portion.
Figure 5A:
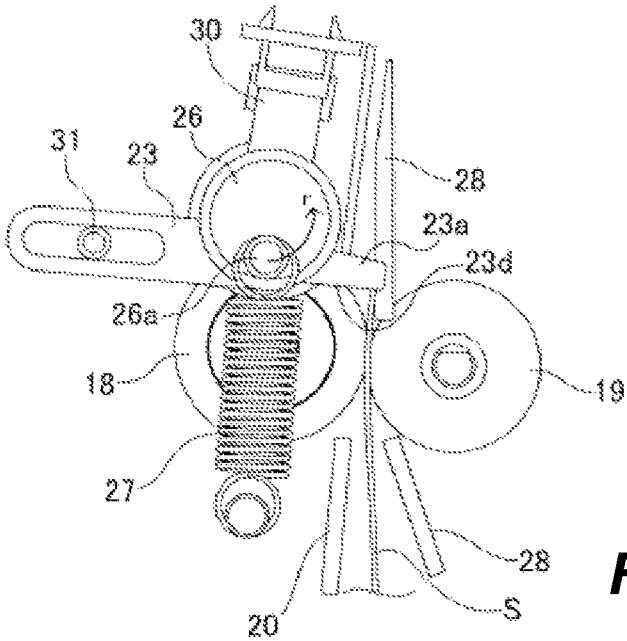
FIG. 5A is a diagram illustrating a sheet conveying portion in a state that the front end of the sheet abuts on the abutting surface of the rotating lever.
Figure 5B:
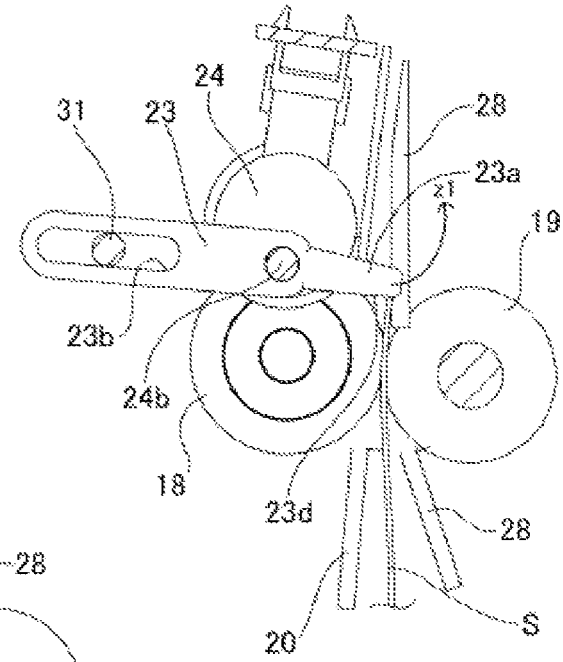
FIG. 5B is a diagram illustrating a rotating lever in a state that the front end of the sheet abuts on the abutting surface.
Figure 5C:
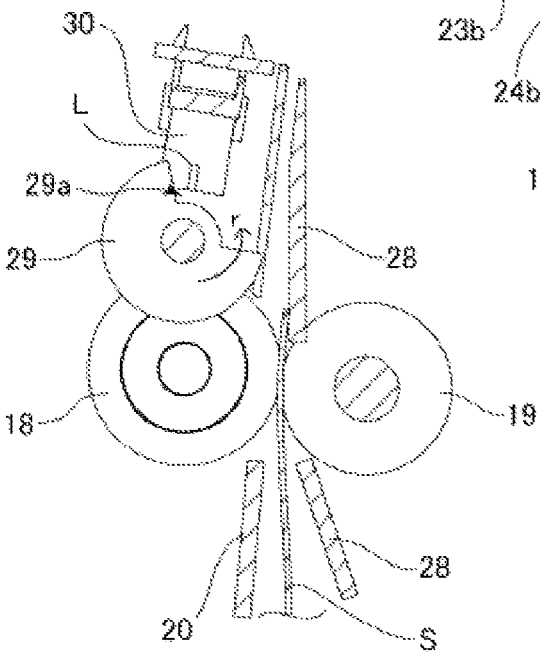
FIG. 5C is a diagram illustrating a light-shielding flag in a state that the front end of the sheet abuts on the abutting surface of the rotating lever.
Figure 6A:
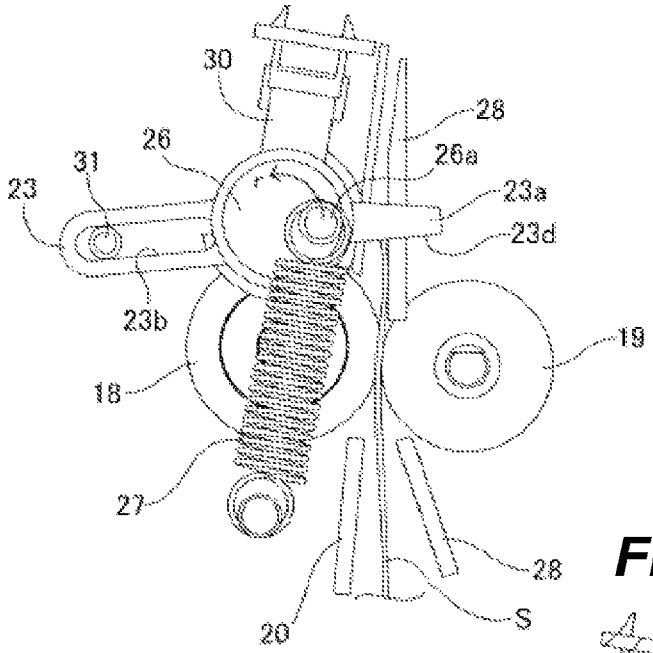
FIG. 6A is a diagram illustrating the sheet conveying portion in a state that the rotating lever is rotated while it is pressed by the front end of the sheet.
Figure 6B:
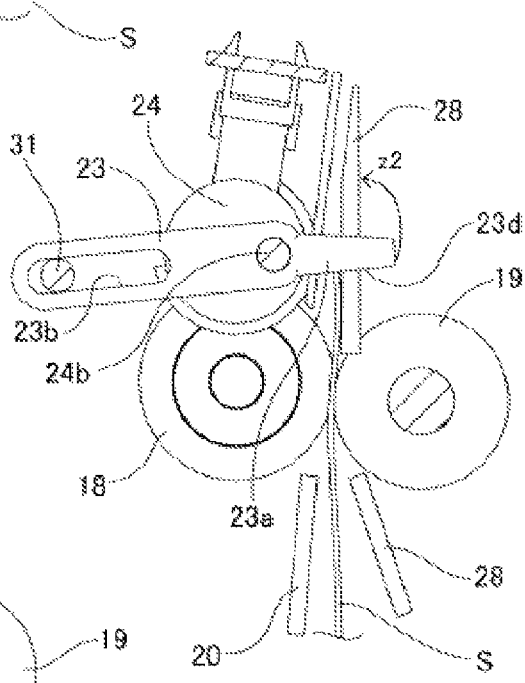
FIG. 6B is a diagram illustrating the rotating lever rotated by the pressing of the front end of the sheet.
Figure 6C:
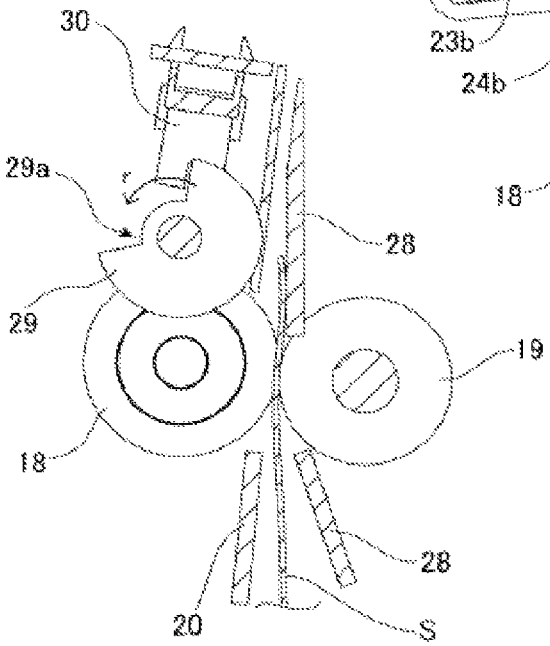
FIG. 6C is a diagram illustrating the light-shielding flag in a state that the rotating lever is rotated while it is pressed by the front end of the sheet.

Next, the operation of the sheet conveying portion 9 will be described with reference to FIGS. 4A to 10 in addition to FIG. 1. FIG. 4A is a diagram illustrating a state that the sheet S is conveyed to the sheet conveying portion 9 according to the first embodiment of the invention. FIG. 4B is a diagram illustrating a rotating lever 23 in a state that the sheet S is conveyed to the sheet conveying portion 9. FIG. 4C is a diagram illustrating the light-shielding flag 29 in a state that the sheet S is conveyed to the sheet conveying portion 9. FIG. 5A is a diagram illustrating a sheet conveying portion 9 in a state that the front end of the sheet S abuts on the abutting surface 23*d* of the rotating lever 23. FIG. 5B is a diagram illustrating a rotating lever 23 in a state that the front end of the sheet S abuts on the abutting surface 23*d*. FIG. 5C is a diagram illustrating the light-shielding flag 29 in a state that the front end of the sheet S abuts on the abutting surface 23*d* of the rotating lever 23. FIG. 6A is a diagram illustrating the sheet conveying portion 9 in a state that the rotating lever 23 is rotated by the pressing of the front end of the sheet S. FIG. 6B is a diagram illustrating the rotating lever 23 rotated by the pressing of the front end of the sheet S. FIG. 6C is a diagram illustrating the light-shielding flag 29 in a state that the rotating lever 23 is rotated by the pressing of the front end of the sheet S.

Figure 7A:
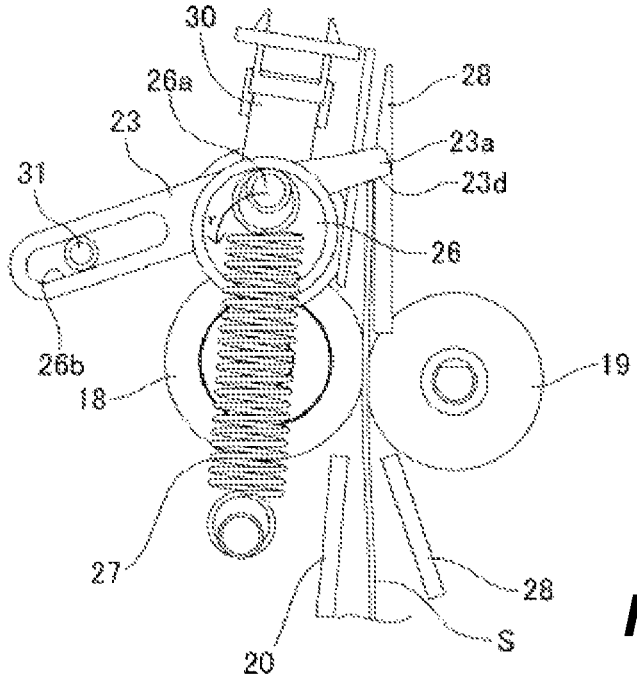
FIG. 7A is a diagram illustrating the sheet conveying portion in a state that the rotating lever is located in the second position while it is pressed by the front end of the sheet.
Figure 7B:
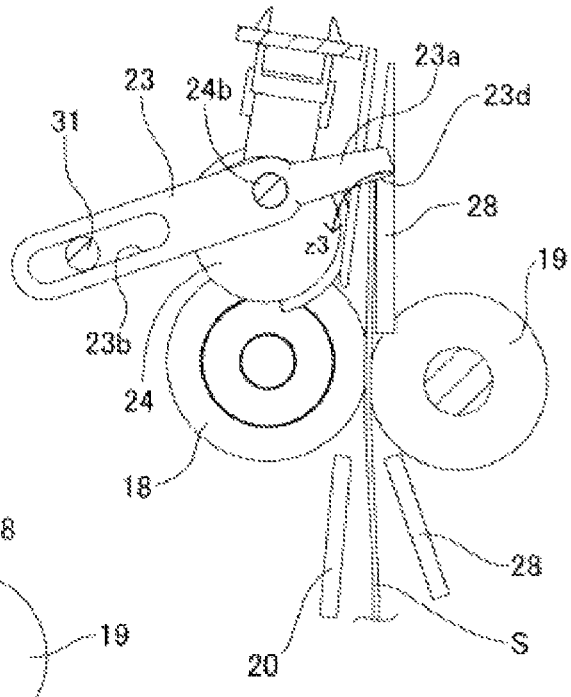
FIG. 7B is a diagram illustrating the rotating lever in a state that the rotating lever is located at the second position by the pressing of the front end of the sheet.
Figure 7C:
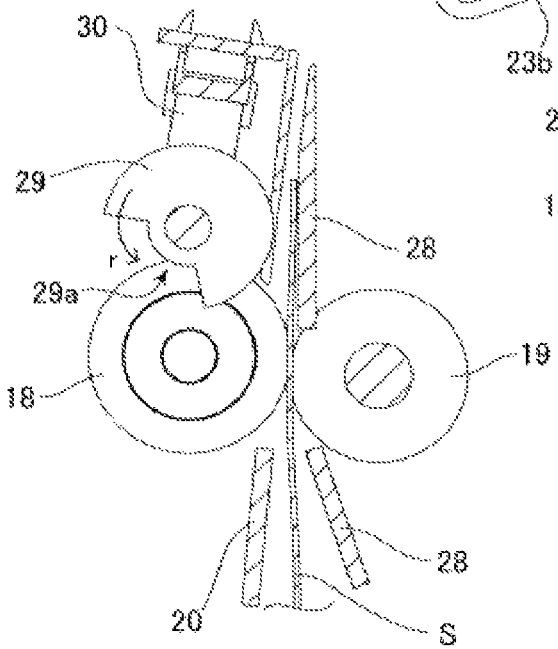
FIG. 7C is a diagram illustrating the light-shielding flag in a state that the rotating lever is located at the second position by the pressing of the front end of the sheet.
Figure 8A:
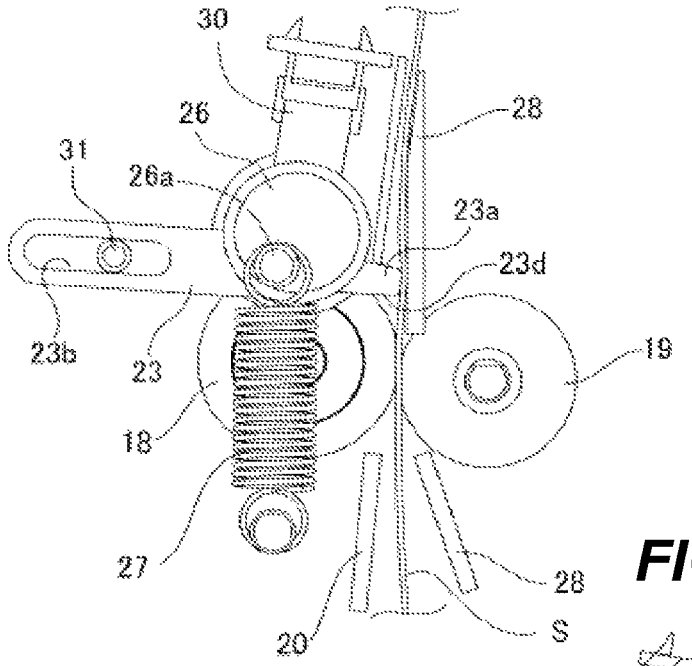
FIG. 8A is a diagram illustrating the sheet conveying portion in a state that the rotating lever moves from the second position to the third position.
Figure 8B:
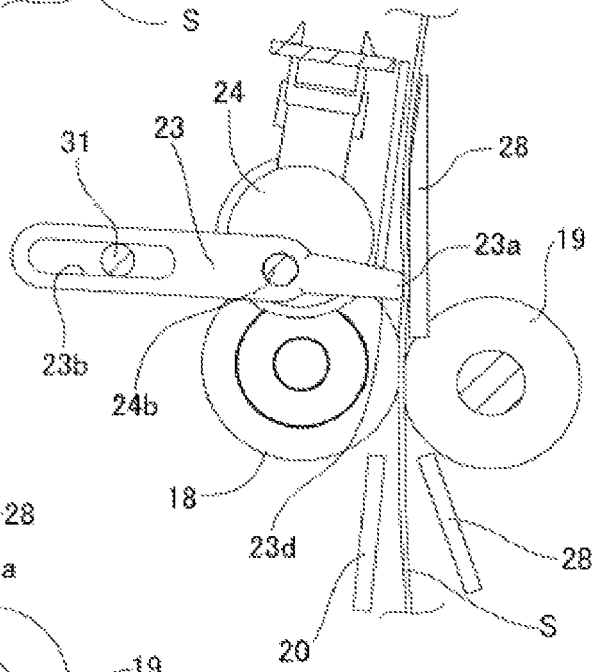
FIG. 8B is a diagram illustrating the rotating lever which moves from the second position to the third position.
Figure 8C:
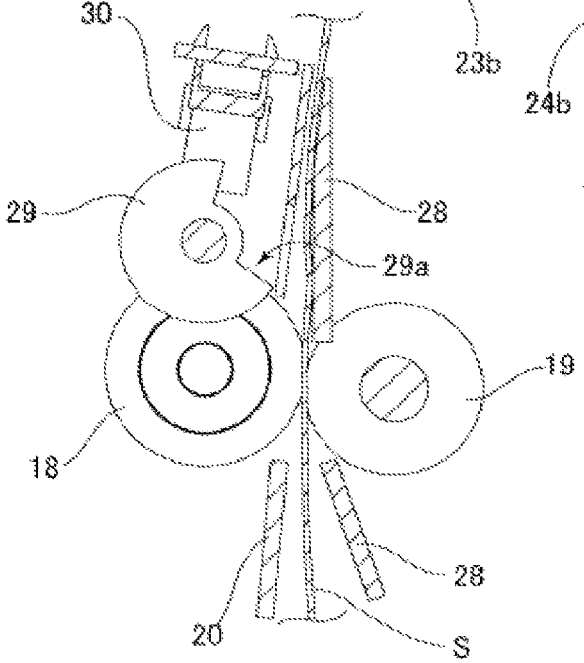
FIG. 8C is a diagram illustrating the light-shielding flag in a state that the rotating lever moves from the second position to the third position.
Figure 9A:
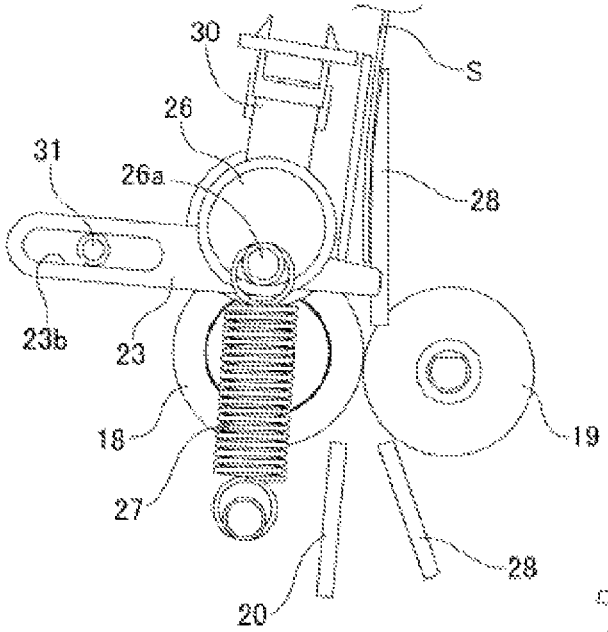
FIG. 9A is a diagram illustrating the sheet conveying portion in a state that the rotating lever moves from the third position to the first position.
Figure 9B:
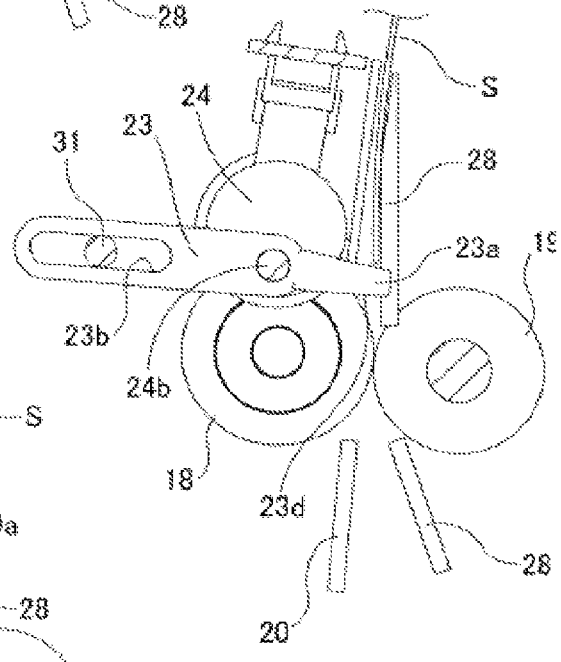
FIG. 9B is a diagram illustrating the rotating lever in a state that it moves from the third position to the first position.
Figure 9C:
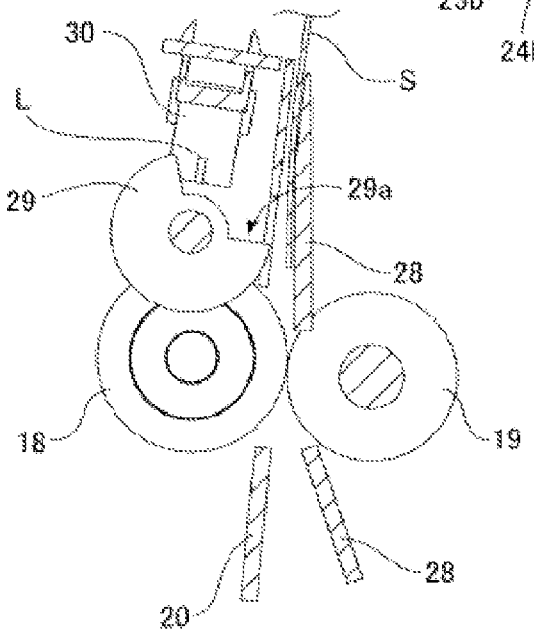
FIG. 9C is a diagram illustrating the light-shielding flag in a state the rotating lever moves from the third position to the first position.
Figure 10:
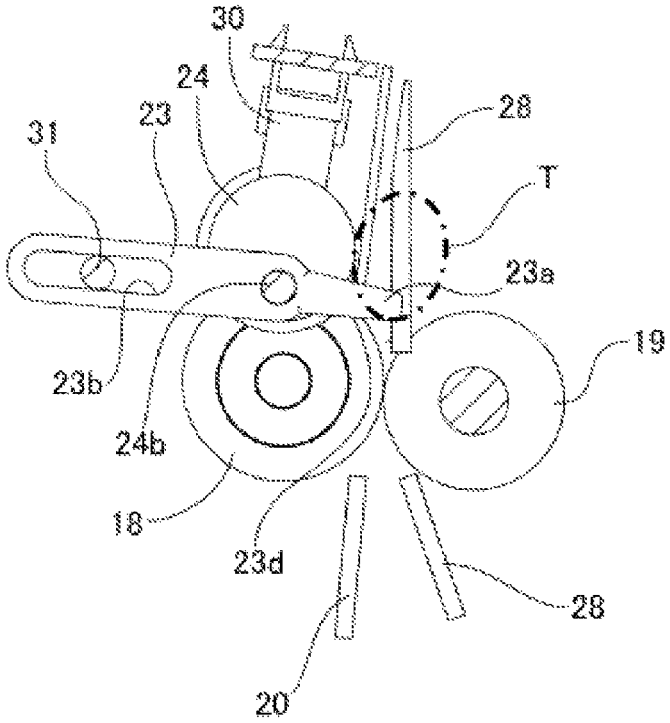
FIG. 10 is a diagram illustrating a rotating trajectory of the abutting surface of the rotating lever which cyclically moves from the first position to the third position while the abutting surface is directed to an upstream side.

FIG. 7A is a diagram illustrating the sheet conveying portion 9 in a state that the rotating lever 23 is located at the second position by the pressing of the front end of the sheet S. FIG. 7B is a diagram illustrating the rotating lever 23 in a state that the rotating lever 23 is located at the second position by the pressing of the front end of the sheet S. FIG. 7C is a diagram illustrating the light-shielding flag 29 in a state that the rotating lever 23 is located at the second position by the pressing of the front end of the sheet S. FIG. 8A is a diagram illustrating the sheet conveying portion 9 in a state that the rotating lever 23 moves from the second position to the third position. FIG. 8B is a diagram illustrating the rotating lever 23 which moves from the second position to the third position. FIG. 8C is a diagram illustrating the light-shielding flag 29 in a state that the rotating lever 23 moves from the second position to the third position. FIG. 9A is a diagram illustrating the sheet conveying portion 9 in a state that the rotating lever 23 moves from the third position to the first position. FIG. 9B is a diagram illustrating the rotating lever 23 in a state that it moves from the third position to the first position. FIG. 9C is a diagram illustrating the light-shielding flag 29 in a state that the rotating lever 23 moves from the third position to the first position. FIG. 10 is a diagram illustrating a rotating trajectory T of the abutting surface 23*d* of the rotating lever 23 which cyclically moves from the first position to the third position in a state that it is directed to the upstream side.

As illustrated in FIGS. 4A and 4B, the abutting portion 23*a* of the rotating lever 23 is held at the first position in a standby state by virtue of a biasing force of the biasing spring 27 while the front end of the sheet S does not abut on the abutting surface 23*d* of the rotating lever 23. In addition, at the first position, as illustrated in FIG. 4C, the light path L of the optical sensor 30 is held in a state that the light does not blocked by the slit portion 429*b* of the light-shielding flag 29.

Next, as illustrated in FIG. 5A, as the front end of the sheet S conveyed by a pair of conveying rollers 18 and 19 abuts on the abutting surface 23*d* of the rotating lever 23, the sheet S presses the abutting surface 23*d* against the holding force of the lever driving member 26 biased by the biasing spring 27. As the abutting surface 23*d* is pressed by the sheet S, the lever driving member 26 is rotated to the arrow direction r of FIG. 5A against the biasing force of the biasing spring 27. At this time, the light-shielding flag 29 of FIG. 5C is also rotated to the arrow direction r of FIG. 5C. As the lever driving member 26 and the light-shielding flag 29 are rotated to the arrow direction r, the long hole portion 23*b* is guided to the support axis 31*b* and slides, and the rotating lever 23 is rotated. As the rotating lever 23 is rotated, the abutting surface 23*d* moves to the arrow direction z1 of FIG. 5B.

At this time, the front end of the sheet S is guided by the sheet-passing guide arranged in the downstream side of the sheet conveying direction of a pair of conveying rollers 18 and 19. As illustrated in FIG. 5C the sheet-passing guide includes a paper feeding frame 20 and a guide frame 28. For this reason, the front end of the sheet S from being separated may be prevented from the abutting surface 23*d* and rotation while the abutting surface 23*d* of the rotating lever 23 is reliably pressed may be provided by the front end of the sheet S.

As illustrated in FIGS. 6A and 6B, as the abutting surface 23*d* is pressed by the front end of the sheet S, the long hole portion 23*b* is guided to the support axis 31*b* and slides, and the rotating lever 23 is rotated against the biasing force of the biasing spring 27. As the rotating lever 23 is rotated, the abutting surface 23*d* moves to the arrow direction z2 of FIG. 6B. Similarly, the lever driving member 26 is rotated to the arrow direction r of FIG. 6A, and the light-shielding flag 29 is also rotated to the arrow direction r of FIG. 6C.

As the rotating lever 23 is further rotated, as illustrated in FIGS. 7A and 7B, the connected portion 23*c* of the rotating lever 23 arrives at the top dead point (hereinafter, refer to as a "second position") of the lever driving member 26 where the biasing spring 27 is biased at maximum. As the rotating lever 23 arrives at the second position, the force for rotating the lever driving member 26 is switched from the force of the sheet S for pressing the rotating lever 23 to the biasing force of the biasing spring 27 for returning the abutting portion 23*a* to the first position. Moreover, the abutting surface 23*d* of the rotating lever 23 moves to the arrow direction z3 of FIG. 7B by virtue of the biasing force of the biasing spring 27, the abutting portion 23*a* is retracted from the sheet conveying path 15*a*, and the abutting surface 23*d* is retracted from the front end of the sheet S. Similarly, as illustrated in FIG. 7C, the light path L of the optical sensor 30 is blocked by the light-shielding flag 29. If the light path L of the optical sensor 30 is blocked, the sheet detector 200 detects that the rotating lever 23 is rotated to a predetermined rotating position, and the front end of the sheet S is conveyed to a desired position. In addition, a predetermined signal is transmitted to the image forming portion 14, and the image forming portion 14 initiates formation of the toner image when the image forming portion 14 receives this signal.

Here, although the rotating lever 23 moves to the arrow direction z3 of FIG. 7B by the biasing force of the biasing spring 27, the sheet S is conveyed by a pair of conveying rollers 18 and 19 (while it passes through the first position in sheet conveying path 15*a*). Therefore, as illustrated in FIGS. 8A and 8B, the rotating lever 23 waits in a state that the front end of the abutting portion 23*a* abuts on the surface of the sheet S while the rotating lever 23 is biased by the biasing spring 27 (hereinafter, referred to as a "third position"). In addition, as illustrated in FIG. 8C, the light path L of the optical sensor 30 is blocked by the light-shielding flag 29 even in this state.

Moreover, as the rear end (trailing end) of the sheet S passes through the front end of the abutting portion 23*a*, the rotating lever 23 initiates rotation to make the abutting portion 23*a* locate at the first position by the biasing force of the biasing spring 27. Furthermore, as the rear end of the sheet S recedes from the abutting portion 23*a*, the rotating lever 23 has a state that the abutting portion 23*a* protrudes to the sheet conveying path 15*a*, and the abutting surface 23*d* waits at the first position for aligning the front end of the next sheet S as illustrated in FIGS. 9A and 9B. At this time, in the light path L of the optical sensor 30, the light-blocking by the light-shielding flag 29 is removed, and the optical sensor 30 generates a transmission signal as illustrated in FIG. 9C. As a result, the rear end of the sheet S may be detected.

In this manner, by repeating the state illustrated in FIGS. 4A to 9C, the rotating lever 23 cyclically moves to the first position, to the second position, and to the third position along a rotating trajectory T of FIG. 10 while the abutting surface 23*d* is directed to the upstream side of the sheet conveying direction. In other words, the abutting surface 23*d* performs an approximate elliptical movement by the unidirectional rotation of a pair of rotating members 24 and 25 and the lever driving member 26.

The image forming apparatus 100 according to the first embodiment having the configuration described above, it is possible to obtain the following effects. The sheet detector 200, of the image forming apparatus 100 according to the first embodiment of the invention cyclically moves to the first position, to the second position, and to the third position while the abutting surface 23*d* of the rotating lever 23 is directed to the upstream side, and waits in the third position of the upstream side until the sheet S passes. Then, the abutting portion 23*a* is located at the first position as the sheet S passes through the front end of the rotating lever 23. Therefore, it is possible to shorten the time that the rotating lever 23 returns to the first position from the standby position until the sheet S passes through the abutting portion 23*a* in comparison with a reciprocating movement of the related art. As a result, it is possible to suppress the sheet interval from being lengthened even when the conveying speed of the sheet S increases. Therefore, it is possible to return the abutting portion 23*a* to the first position within a short sheet interval under a fast conveying speed condition unlike the related art. As a result, it is possible to improve the throughput.

For example, according to the first embodiment of the invention, it is possible to reduce the sheet interval to approximately a half compared to the rotating lever of the related art which performs the reciprocating movement. Therefore, it is possible to satisfy user's demands for further improving the throughput of the image forming apparatus. In addition, as illustrated in FIG. 10, it is possible to reduce the rotating trajectory T of the abutting surface 23*d* of the rotating lever 23 in a small elliptical shape. Therefore, it is possible to arrange the image forming apparatus, for example, even in areas where space or arrangement is limited.

According to the first embodiment of the invention, the rotating lever 23 is supported by the supporting mechanism having the support axis 31 and a pair of rotating members 24 and 25. Therefore, it is possible to transmit the rotational driving force to the rotating lever 23 with a simple configuration. As a result, it is possible to, for example, manufacture the image forming apparatus at low cost or suppress a manufacturing cost. In addition, according to the embodiment described above, the main portion 23*e* of the rotating lever 23 is slidably supported by forming the long hole portion 23*b* in the rotating lever 23 and fitting the support axis 31 of the paper feeding frame 20 to the long hole portion 23*b* by insertion. However, for example, the main portion 23*e* of the rotating lever 23 may be slidably configured by forming, in the paper feeding frame 20, the long hole where a pin protruding from the rotating lever 23 is fitted by insertion.

Second Embodiment

Next, the image forming apparatus 100A according to a second embodiment of the invention will be described with reference to FIGS. 11A to 12B along with FIG. 1. The image forming apparatus 100A according to the second embodiment of the invention is different from that of the first embodiment in that the follower roller 22 is provided in the front end of the rotating lever 223 as a follower roller. For this reason, in the second embodiment, a description will be made by focusing on a difference from the first embodiment, that is, the follower roller 22 provided in the front end of the rotating lever 223. In the second embodiment, like reference numerals denote like elements as in the image forming apparatus 100 according to the first embodiment, and the description thereof will not be repeated. According to the second embodiment of the invention, it is possible to obtain the effects similar to those of the first embodiment in the configuration similar to that of the first embodiment.

Figure 11A:
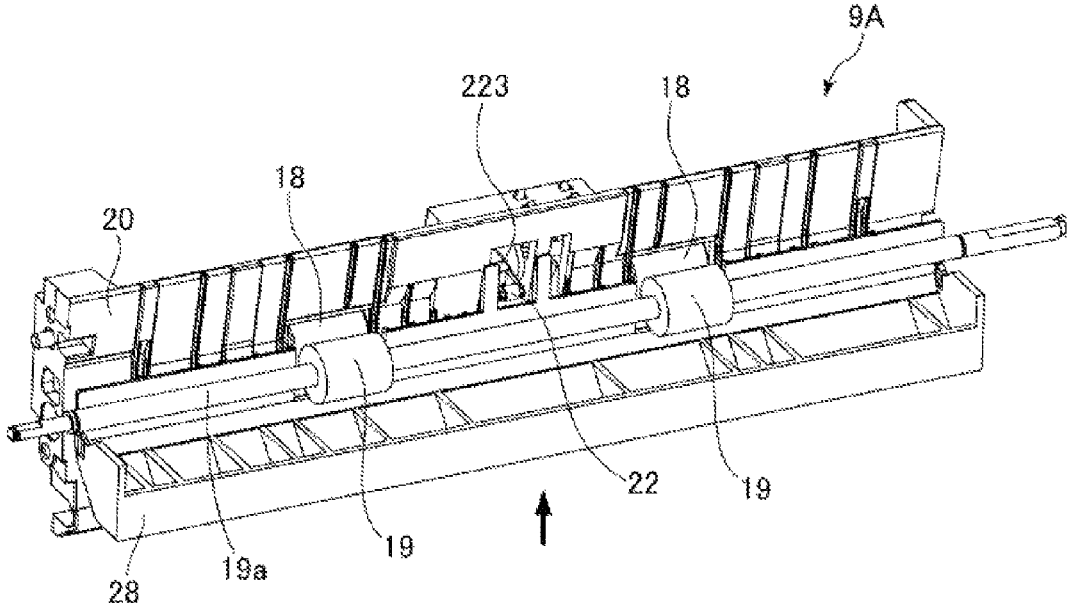
FIG. 11A is a perspective view illustrating the sheet conveying portion of the image forming apparatus according to a second embodiment of the invention.
Figure 11B:
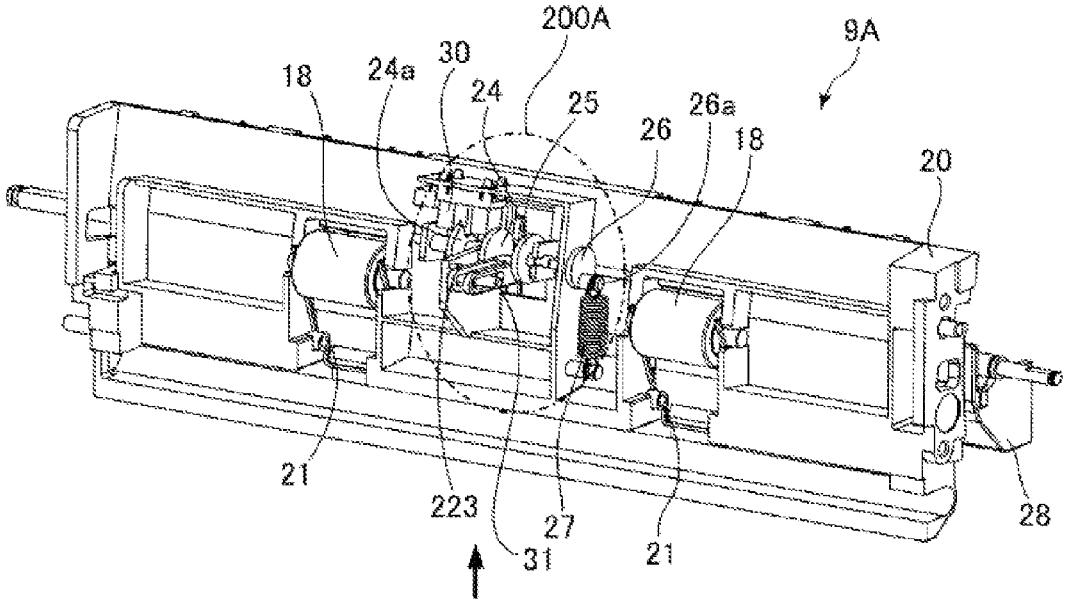
FIG. 11B is a perspective view illustrating the sheet conveying portion of FIG. 11A as seen from the opposite side.
Figure 12A:
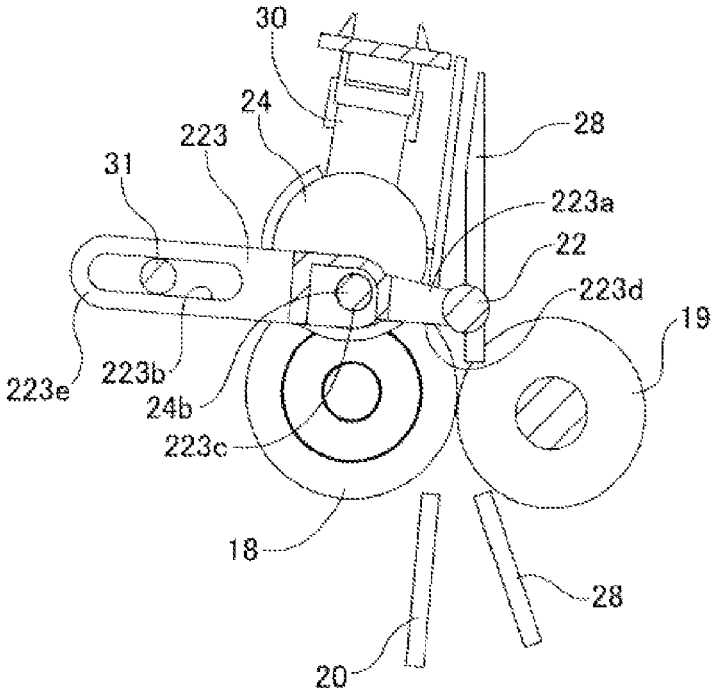
FIG. 12A is a diagram illustrating the sheet conveying portion of the image forming apparatus according to the second embodiment of the invention.
Figure 12B:
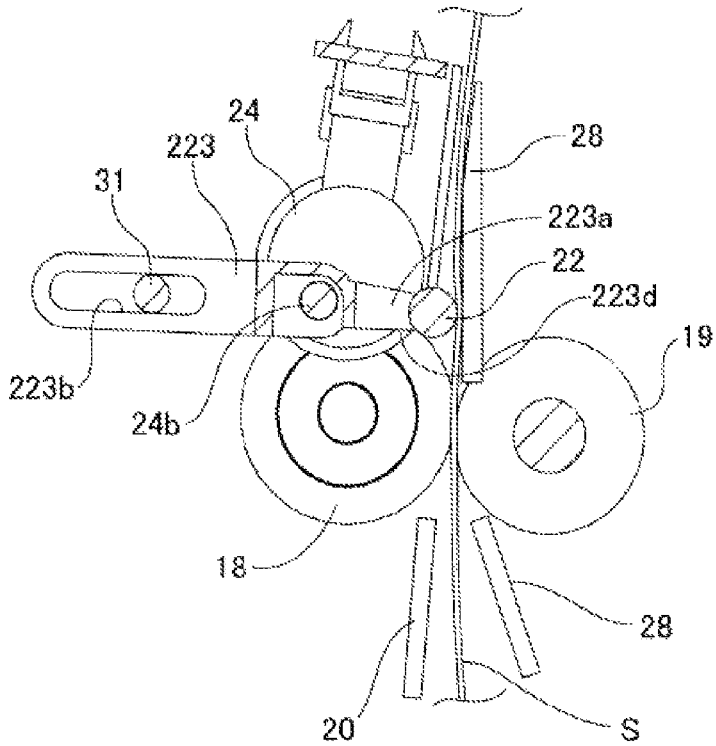
FIG. 12B is a diagram illustrating a state that the rotating lever of the sheet conveying portion of FIG. 12A waits at the third position.

First, the entire structure of the image forming apparatus 100A according to the second embodiment will be described with reference to FIGS. 11A to 12B. FIG. 11A is a perspective view illustrating the sheet conveying portion 9A of the image forming apparatus 100A according to the second embodiment of the invention. FIG. 11B is a perspective view illustrating the sheet conveying portion 9A illustrated in FIG. 11A as seen from the opposite side. FIG. 12A is a diagram illustrating the sheet conveying portion 9A of the image forming apparatus 100A according to the second embodiment of the invention. FIG. 12B is a diagram illustrating a state in which the rotating lever 223 of the sheet conveying portion 9A illustrated in FIG. 12A waits in the third position. Arrows illustrated in FIGS. 11A and 11B represent the conveying direction of the sheet S.

As illustrated in FIG. 1, the image forming apparatus 100A includes the sheet feeding portion 8, the sheet conveying portion 9A which conveys the sheet S while detecting the front or rear end of the sheet S fed from the sheet feeding portion 8, the image forming portion 14, the fixing portion 10, and the sheet discharge portion 13. As illustrated in FIGS. 11A and 11B, the sheet conveying portion 9A includes the paper feeding frame 20, the guide frame 28, a pair of conveying rollers 18 and 19, and the sheet detector 200A. The sheet detector 200A includes the rotating lever 223, the support axis 31, a pair of rotating members 24 and 25, the rotating axes 25*a* and 24*a*, the lever driving member 26, the biasing spring 27, the light-shielding flag 29, and the optical sensor 30.

As illustrated in FIG. 12A, the rotating lever 223 includes the main portion 23*e*, the abutting portion 23*a*, the follower roller 22 provided in the front end of the abutting portion 23*a*, the long hole portion 23*b*, and the connected portion 23*c*. The follower roller 22 is formed such that the roller surface of the follower roller 22 is contacted by rolling with the surface (rear surface) of sheet S conveyed along the sheet conveying path 15*a* when the rotating lever 23 waits in the third position as illustrated in FIG. 12B.

Next, the operation of the sheet conveying portion 9A of the image forming apparatus 100A according to the second embodiment of the invention will be described. Since the basic operation of the sheet conveying portion 9A is similar to that of the first embodiment, the description thereof will not be repeated, and the operation of the rotating lever 223 of the sheet detector 200A at the third position will be only described. As illustrated in FIG. 12B, in the third position, while the rotational force is generated in the rotating lever 223 by the biasing spring 27 and the lever driving member 26, the rotating lever 223 is held in balance between the rotational force and the stiffness of the sheet S. In this state, the follower roller 22 provided in the front end of the rotating lever is contacted by rolling with the sheet S in the middle of conveying, and the rotating lever 223 waits in the third position while the front end is contacted by rolling. Then, as the rear end of the sheet S passes, the rotating lever 223 is rotated to the first position from the third position.

In the image forming apparatus 100A according to the second embodiment having the configuration described above, it is possible to obtain the following effects. In the sheet detector 200A of the image forming apparatus 100A according to the second embodiment, the follower roller 22 is provided in the front end of the rotating lever 3. For this reason, the front end of the rotating lever 23 can wait in the third position in contact with the sheet S while the front end of the rotating lever 223 is contacted by rolling with the surface (rear surface) of the sheet S conveyed along the sheet conveying path 15*a*. As a result, it is possible to suppress formation of the contact traces or the like on the surface (rear surface) of the sheet S generated when the surface (rear surface) of the sheet S and the front end of the rotating lever 23 rub with each other.

Third Embodiment

Next, the image forming apparatus 100B according to a third embodiment of the invention will be described with reference to FIGS. 13A to 17 along with FIG. 1. The image forming apparatus 100B according to the third embodiment of the invention is different from the first embodiment in terms of the rotating lever 323 and the supporting mechanism of the rotating lever 323. For this reason, in the third embodiment, description will be made by focusing on a difference from the first embodiment, that is, the rotating lever 323 and the supporting mechanism of the rotating lever 323. In the third embodiment, like reference numerals denote like elements as in the image forming apparatus 100 according to the first embodiment, and the description thereof will not be repeated. In the third embodiment, it is possible to obtain the effects similar to those of the first embodiment in the configuration similar to that of the first embodiment.

Figure 13A:
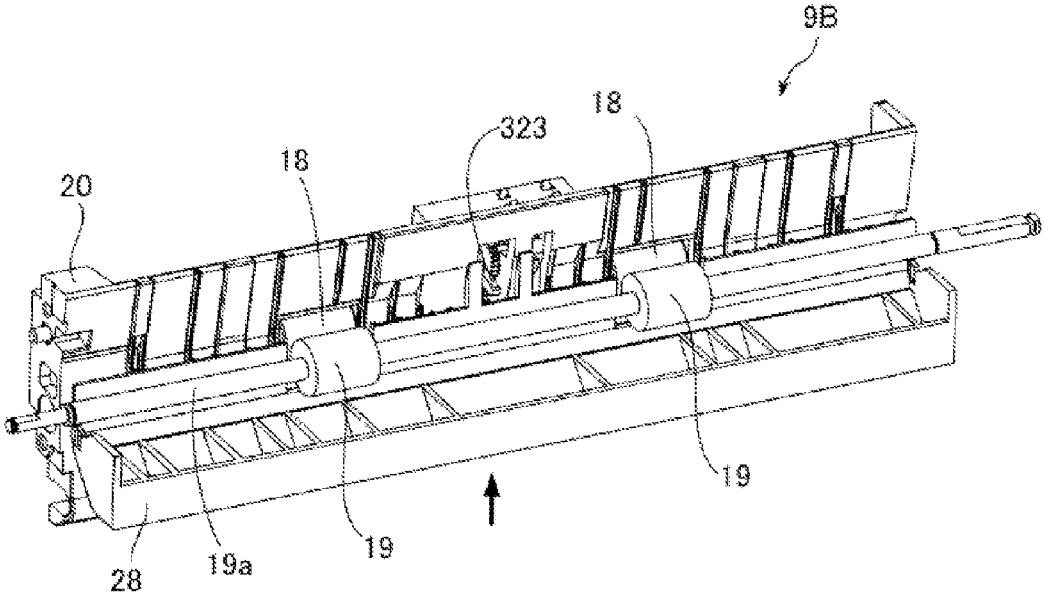
FIG. 13A is a perspective view illustrating the sheet conveying portion of the image forming apparatus according to a third embodiment of the invention.
Figure 13B:
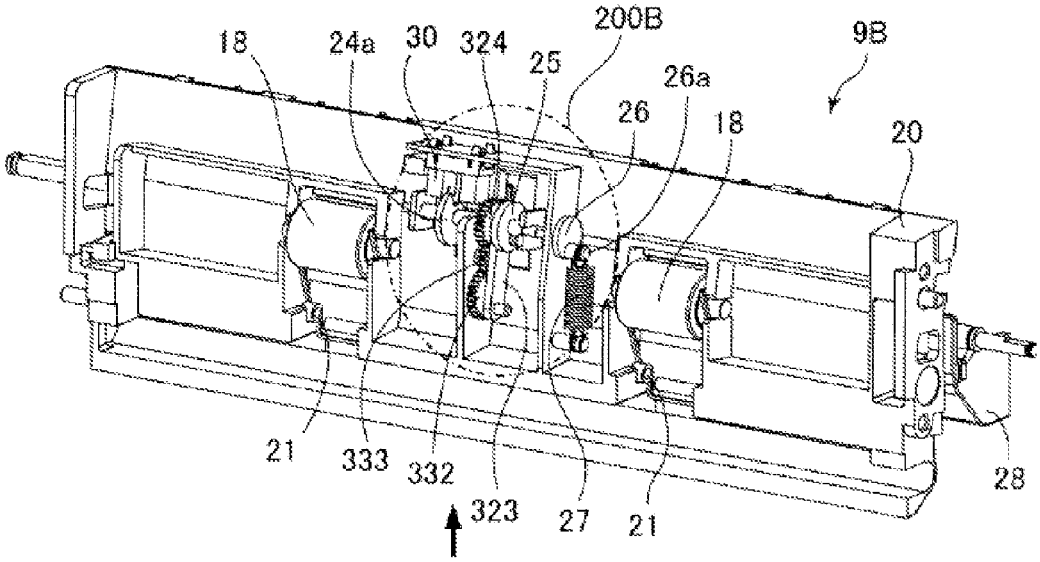
FIG. 13B is a perspective view illustrating the sheet conveying portion of FIG. 13A as seen from the opposite side.
Figure 14:
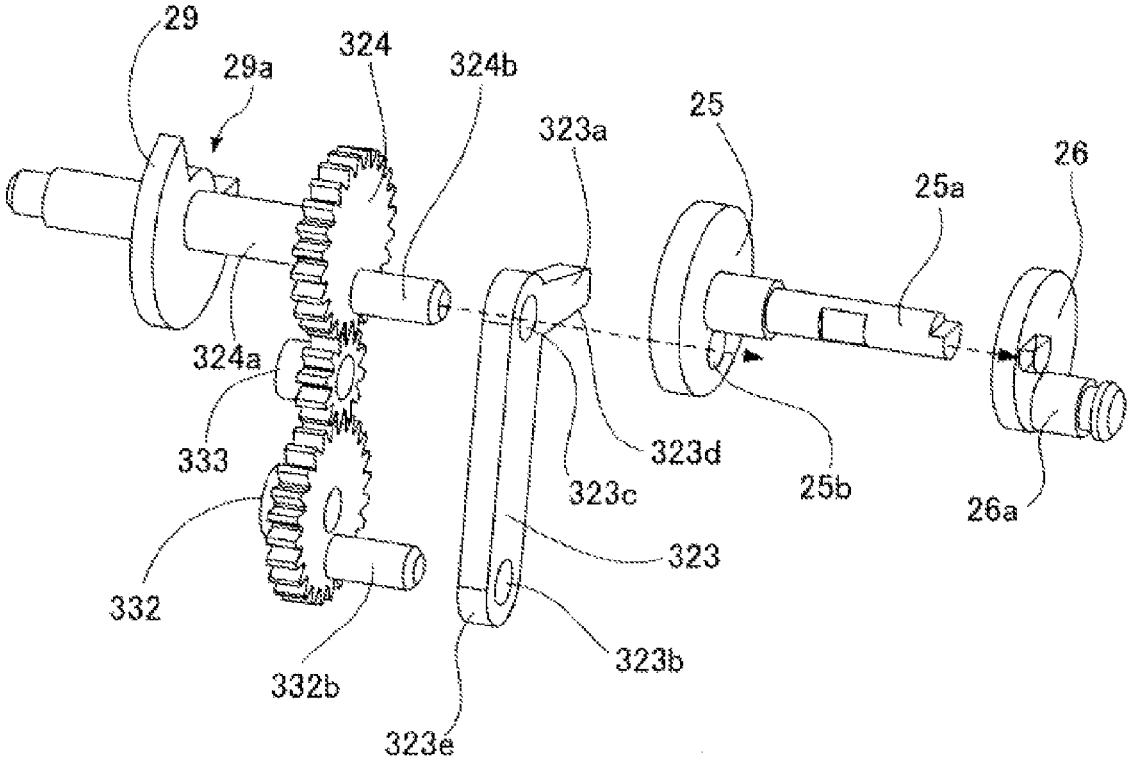
FIG. 14 is an exploded perspective view illustrating a part of the sheet detector according to the third embodiment of the invention.
Figure 15A:
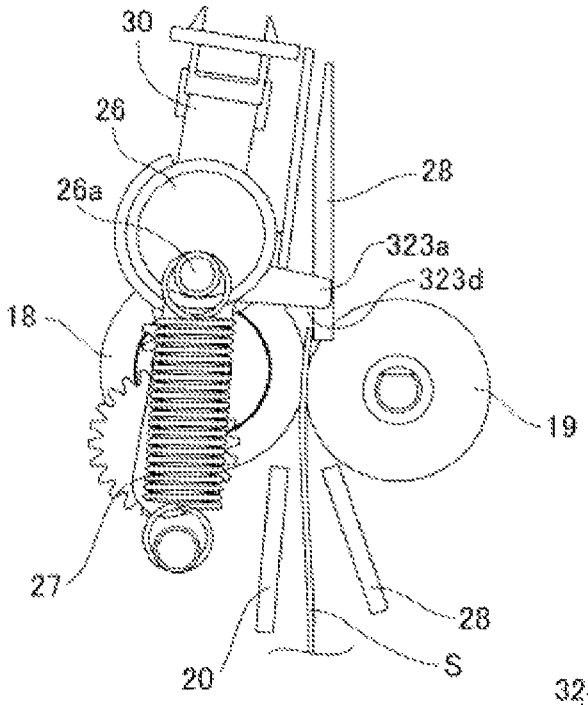
FIG. 15A is a diagram illustrating a state that the sheet is conveyed in the sheet conveying portion according to the third embodiment of the invention.
Figure 15B:
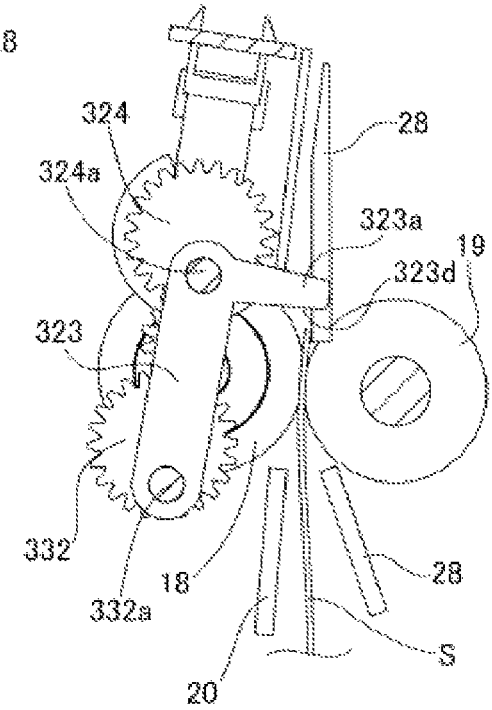
FIG. 15B is a diagram illustrating the rotating lever in a state that the sheet is conveyed to the sheet conveying portion.
Figure 15C:
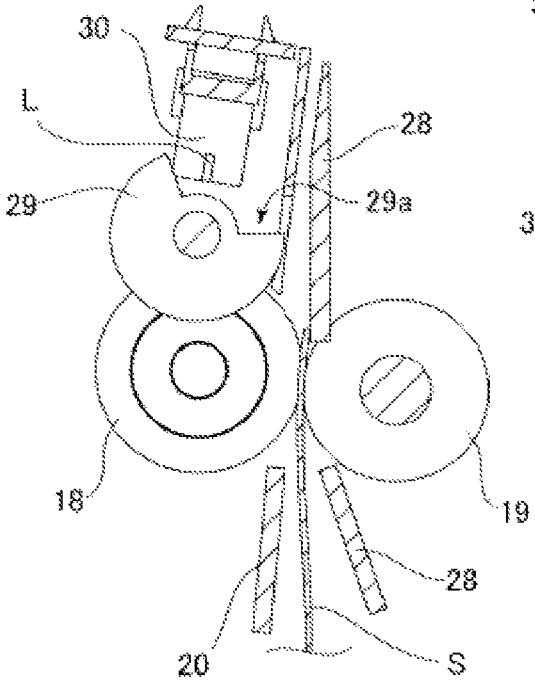
FIG. 15C is a diagram illustrating the light-shielding flag in a state that the sheet is conveyed to the sheet conveying portion.

Next, the entire structure of the image forming apparatus 100B according to the third embodiment of the invention will be described with reference to FIGS. 13A to 15C along with FIG. 1. FIG. 13A is a perspective view illustrating the sheet conveying portion 9B of the image forming apparatus 100B according to the third embodiment of the invention. FIG. 13B is a perspective view illustrating the sheet conveying portion 9B of FIG. 13A as seen from the opposite side. FIG. 14 is an exploded perspective view illustrating a portion of the sheet detector 200B according to the third embodiment of the invention. FIG. 15A is a diagram illustrating a state in which the sheet S is conveyed in the sheet conveying portion 9B according to the third embodiment of the invention. FIG. 15B is a diagram illustrating the rotating lever 323 in a state in which the sheet S is conveyed in the sheet conveying portion 9B. FIG. 15C is a diagram illustrating the light-shielding flag 29 in a state in which the sheet S is conveyed in the sheet conveying portion 9B. Arrows illustrated in FIGS. 13A and 13B represent the conveying direction of the sheet S.

As illustrated in FIG. 1, the image forming apparatus 100B includes the sheet feeding portion 8, the sheet conveying portion 9B which conveys the sheet S while detecting the front or rear end of the sheet S fed from the sheet feeding portion 8, the image forming portion 14, the fixing portion 10, and the sheet discharge portion 13. As illustrated in FIGS. 13A and 13B, the sheet conveying portion 9B includes the paper feeding frame 20, the guide frame 28, a pair of conveying rollers 18 and 19, and the sheet detector 200B.

The sheet detector 200B includes the rotating lever 323, the rotating member 25, the rotational axes 25*a* and 324*a*, the lever driving member 26, the biasing spring 27, the light-shielding flag 29, and the optical sensor 30. In addition, the sheet detector 200B includes the first and second gears 324 and 332 as the first and second rotating members which configure a support mechanism, and the linking gear 333 as the linking member which links the first and second gears 324 and 332 to rotate in the same direction at the same phase.

As illustrated in FIG. 14, the rotating lever 323 includes the main portion 323*e* formed in a strip shape, the abutting portion 323*a* formed in one end of the main portion 323*e* in the longitudinal direction, and the first connected portion 323*b* formed in the other end side of the main portion 323*e*. In addition, the rotating lever 323 includes the second connected portion 323*c* formed in a position parallel to the first connected portion 323*b*. As illustrated in FIGS. 15A and 15B, the abutting portion 323*a* is provided to protrude to the sheet conveying path 15*a* at the first position and includes the abutting surface 323*d* where the front end of the sheet S which moves along the sheet conveying path 15*a* can abut at the first position. The second connected portion 323*c* is formed in the vicinity of a base end of the abutting portion 323*a* in the rotating lever 323. The first connected portion 323*b* is formed in the opposite end of the second connected portion 323*c*.

The first gear 324 is connected to the rotational axis 324*a* and includes the first connecting axis 324*b* as the first connecting portion which extends in parallel with the rotational axis 324*a* in a position offset radially from the center of rotation (eccentric position). The first connecting axis 324*b* is formed to penetrate the second connected portion 323*c* and is fitted by insertion to the connection hole 25*b* of the rotating member 25 after penetrating the second connected portion 323*c*. As a result, the rotating lever 323 can rotate together with the first gear 324.

The second gear 332 is arranged around the axis parallel to the first gear 324. In addition, the second gear 332 includes the second connecting axis 332*b* as the second connecting portion which extends in parallel with the rotational axis 324*a* in a position radially offset from the center of rotation (eccentric position). The second connecting axis 332*b* is formed to be connectable to the first connected portion 323*b*, and rotates the rotating lever 323 along with the second gear 332. Moreover, the first and second gears 324 and 332 are formed to have a gear ratio of 1:1.

The linking gear 333 is arranged around the axis parallel to the first and second gears 324 and 332 and meshes with the first and second gears 324 and 332 to rotate the first and second gears 324 and 332 in the same direction at the same phase. The first and second gears 324 and 332 are rotated in the same direction at the same cycle by the linking gear 333.

Figure 16A:
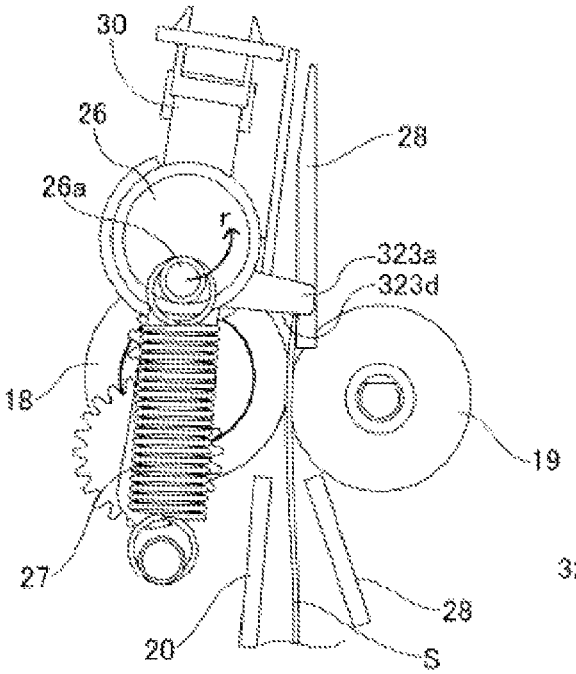
FIG. 16A is a diagram illustrating the sheet conveying portion in a state that the front end of the sheet abuts on the abutting surface of the rotating lever.
Figure 16B:
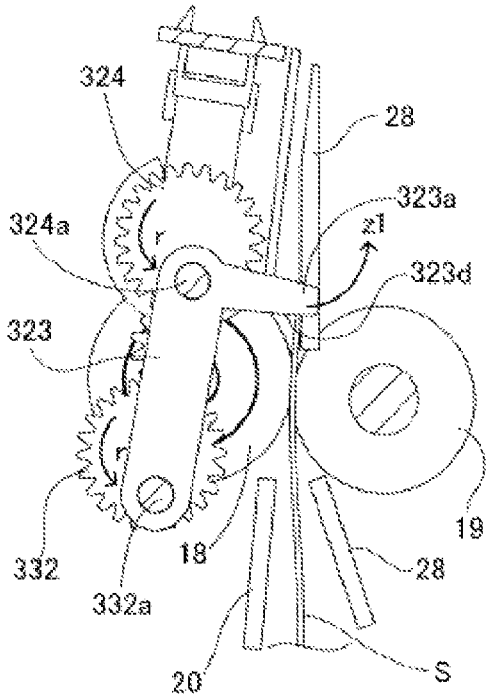
FIG. 16B is a diagram illustrating the rotating lever in a state that the front end of the sheet abuts on the abutting surface.
Figure 16C:
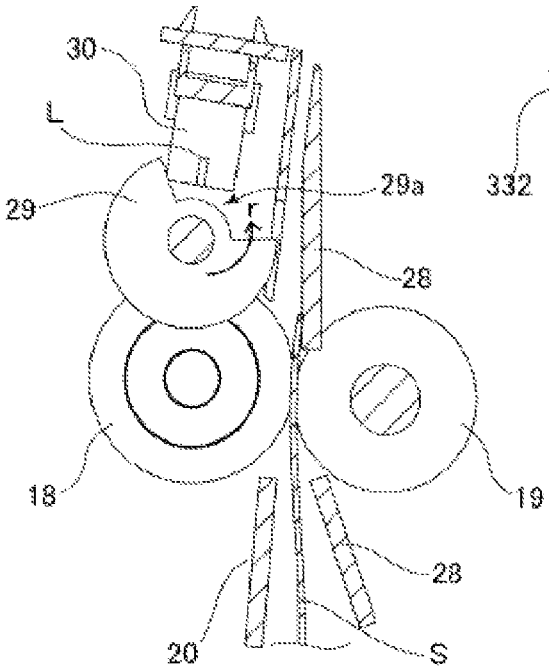
FIG. 16C is a diagram illustrating the light-shielding flag in a state that the front end of the sheet abuts on the abutting surface.
Figure 17:
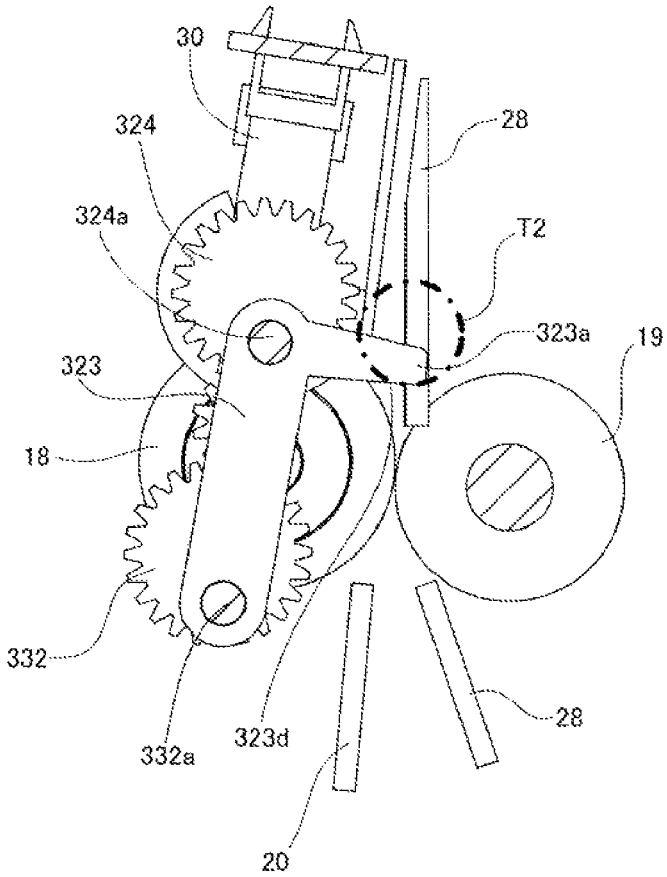
FIG. 17 is a diagram illustrating a rotating trajectory of the abutting surface of the rotating lever which cyclically moves from the first position to the third position while the abutting surface is directed to an upstream side.

Next, the operation of the sheet detector 200B will be described with reference to FIGS. 16A to 17 along with FIGS. 15A to 15C. FIG. 16A is a diagram illustrating the sheet conveying portion 9B in a state in which the front end of the sheet S abuts on the abutting surface 323*d* of the rotating lever 323. FIG. 16B is a diagram illustrating the rotating lever 323 in a state in which the front end of the sheet S abuts on the abutting surface 323*d*. FIG. 16C is a diagram illustrating the light-shielding flag 29 in a state in which the front end of the sheet S abuts on the abutting surface 323*d*. FIG. 17 is a diagram illustrating a rotating trajectory T2 of the abutting surface 323*d* of the rotating lever 323 cyclically moving from the first position to the third position while the abutting surface is directed to an upstream side.

As illustrated in FIGS. 15A and 15B, the abutting portion 323*a* of the rotating lever 323 is held at the first position in a standby state by virtue of a biasing force of the biasing spring 27 while the front end of the sheet S does not abut on the abutting surface 323*d* of the rotating lever 323. In addition, at the first position, as illustrated in FIG. 15C, the light path L of the optical sensor 30 is not blocked by the slit portion 29*a* of the light-shielding flag 29.

Next, as illustrated in FIG. 16A, as the front end of the sheet S conveyed by a pair of conveying rollers 18 and 19 abuts on the abutting surface 323*d* of the rotating lever 323, the sheet S presses the abutting surface 323*d* against the holding force of the lever driving member 26 biased by the biasing spring 27. As the abutting surface 323*d* of the sheet S is pressed, the lever driving member 26 is rotated to the arrow direction r of FIG. 16A against the biasing force of the biasing spring 27. At this time, the light-shielding flag 29 of FIG. 16C is also rotated to the arrow direction r of FIG. 16C. The first gear 324 is rotated as the lever driving member 26 and the light-shielding flag 29 are rotated to the direction r, and the second gear 332 is rotated by the linking gear 333 as the first gear 324 is rotated. The rotating lever 323 is rotated when the first gear 324 and the second gear 332 rotate. The abutting surface 323*d* moves to the arrow direction z1 of FIG. 16B as the rotating lever 323 is rotated.

At this time, the front end of the sheet S, as illustrated in FIG. 16C, includes the paper feeding frame 20 and the guide frame 28 and is guided by the sheet-passing guide arranged on the downstream side in the sheet conveying direction of a pair of conveying rollers 18 and 19. For this reason, it is possible to prevent the front end of the sheet S from being separated from the abutting surface 323*d* and provide rotation while the abutting surface 323*d* of the rotating lever 323 is reliably pressed by the front end of the sheet S.

As the rotating lever 323 is further rotated, the connected portion 323*c* of the rotating lever 323 arrives at the top dead point (second position) of the lever driving member 26 where the biasing spring 27 is biased at maximum. As the rotating lever 323 arrives at the second position, the force for rotating the lever driving member 26 is switched from the force that the sheet S presses the rotating lever 323 to the biasing force that the biasing spring 27 returns the abutting portion 323*a* to the first position. Moreover, the abutting surface 323*d* of the rotating lever 323 moves by the biasing force of the biasing spring 27, the abutting portion 323*a* is retracted from the sheet conveying path 15*a*, and the abutting surface 323*d* is retracted from the front end of the sheet S. Similarly, the light path L of the optical sensor 30 is blocked by the light-shielding flag 29. As the light path L of the optical sensor 30 is blocked, the sheet detector 200B detects that the rotating lever 323 is rotated to a predetermined rotating position and the front end of the sheet S is conveyed to a desired position. In addition, a predetermined signal is transmitted to the image forming portion 14, and the image forming portion 14 initiates formation of the toner image as the image forming portion 14 receives the signal. According to the present embodiment, the light path L of the optical sensor 30 is blocked by the light-shielding flag 29 at the second position.

Here, although the rotating lever 323 rotates around the rotating axes 25*a* and 324*a* by the biasing force of the biasing spring 27, the sheet S is conveyed by a pair of conveying rollers 18 and 19 (while passing through the first position in the sheet conveying path 15*a*). For this reason, the rotating lever 323 waits at the third position while it is biased by the biasing spring 27, and the front end of the abutting portion 323*a* abuts on the surface of the sheet S. In addition, the light path L of the optical sensor 30 is blocked by the light-shielding flag 29 even in this state.

Moreover, as the rear end of the sheet S passes through the front end of the abutting portion 323*a*, the rotating lever 323 initiates rotation such that the abutting portion 323*a* is located at the first position by the biasing force of the biasing spring 27. Furthermore, as the rear end of the sheet S recedes from the abutting portion 323*a*, the rotating lever 323 enters a state in which the abutting portion 323*a* protrudes to the sheet conveying path 15*a*, and the abutting surface 323*d* waits at the first position where the abutting surface 323*d* can abut on the front end of the subsequent sheet S. At this time, in the light path L of the optical sensor 30, the light blocking by the light-shielding flag 29 is released, and the optical sensor 30 generates a transmission signal. As a result, it is possible to detect that the sheet S passes.

In this manner, by repeating the process described above, the rotating lever 323 cyclically moves to the first position, to the second position, and to the third position along a rotating trajectory T2 of FIG. 17 while the abutting surface 323*d* is directed to the upstream side in the sheet conveying direction. In other words, the abutting surface 323*d* performs a circular movement by the unidirectional rotation of the first gear 324, the second gear 332, the linking gear 333, the rotating member 25, and the lever driving member 26.

In the image forming apparatus 100B according to the third embodiment having the configuration described above, it is possible to obtain the following effects. The sheet detector 200B of the image forming apparatus 100B according to the third embodiment includes the first gear 324, the second gear 332, and the linking gear 333 in order to rotate the rotating lever 323. Therefore, it is possible to rotate the rotating lever 323 smoothly. Moreover, as illustrated in FIG. 17, it is possible to reduce the rotating trajectory T2 of the front end of the rotating lever 323 in the sheet conveying direction (vertical direction of FIG. 17), compared to the first embodiment, and alleviate restriction in space or arrangement of the image forming apparatus 100B.

Fourth Embodiment

Next, the image forming apparatus 100C according to a fourth embodiment of the invention will be described with reference to FIGS. 18A to 25D along with FIG. 1. In the image forming apparatus 100C according to the fourth embodiment, the rotating member and the biasing portion which applies a force to the rotating lever are different from those of the first embodiment. For this reason, in the fourth embodiment, a description will be made by focusing on a difference from the first embodiment, that is, the rotating member and the biasing portion which applies a force to the rotating lever. In addition, in the fourth embodiment, like reference numerals denote like elements as in the image forming apparatus 100 according to the first embodiment, and the description thereof will not be repeated. In the fourth embodiment, it is possible to obtain the effects similar to those of the first embodiment using the configuration similar to that of the first embodiment.

Figure 18A:
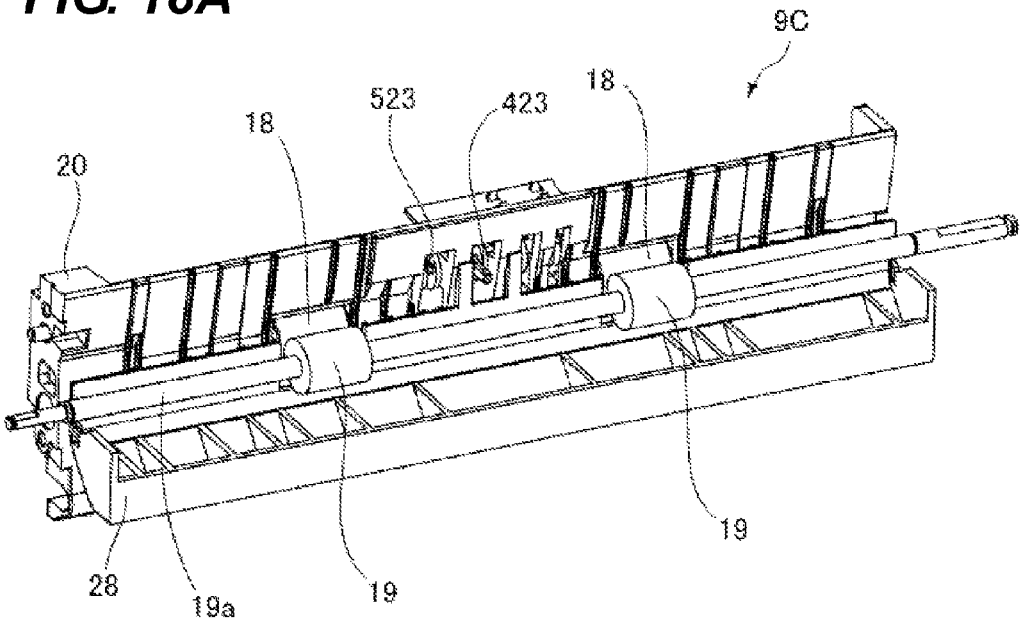
FIG. 18A is a perspective view illustrating the sheet conveying portion of the image forming apparatus according to a fourth embodiment of the invention.
Figure 18B:
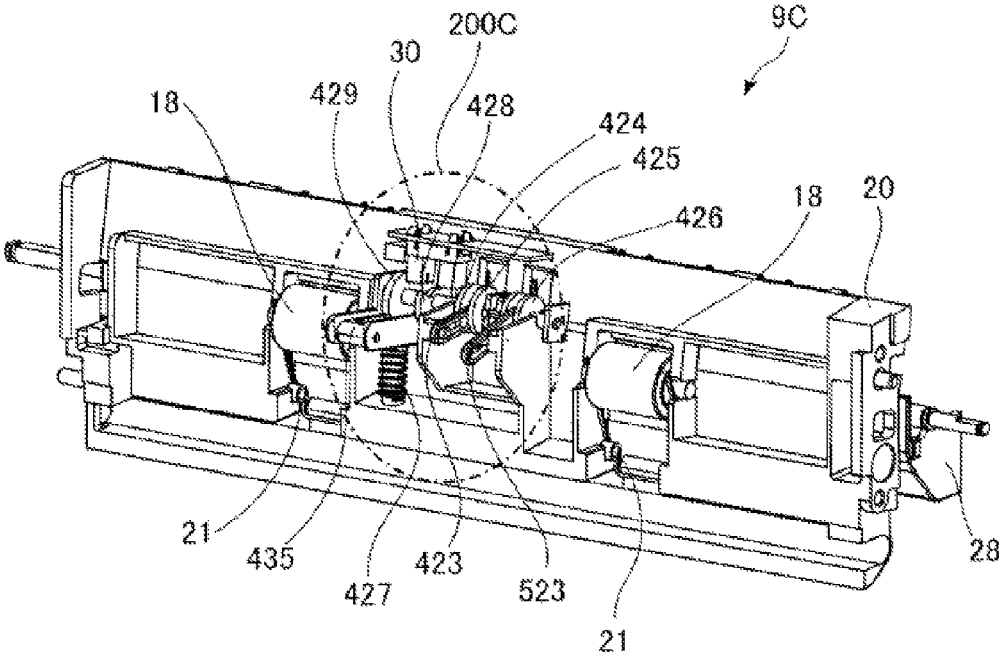
FIG. 18B is a perspective view illustrating the sheet conveying portion of FIG. 18A as seen from the opposite side.
Figure 19:
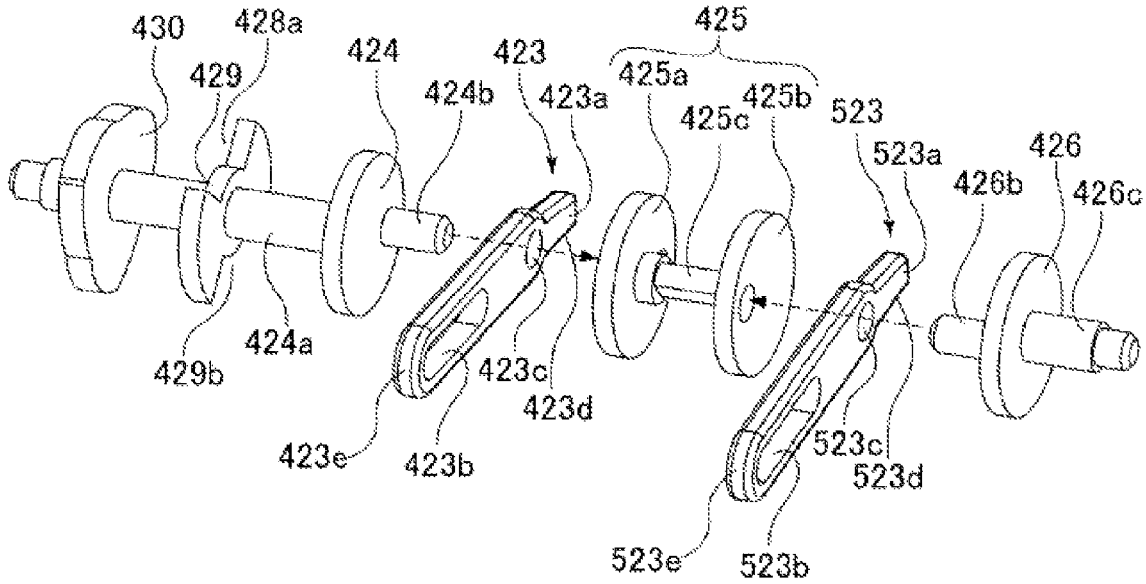
FIG. 19 is an exploded perspective view illustrating a portion of the sheet detector according to the fourth embodiment of the invention.
Figure 20A:
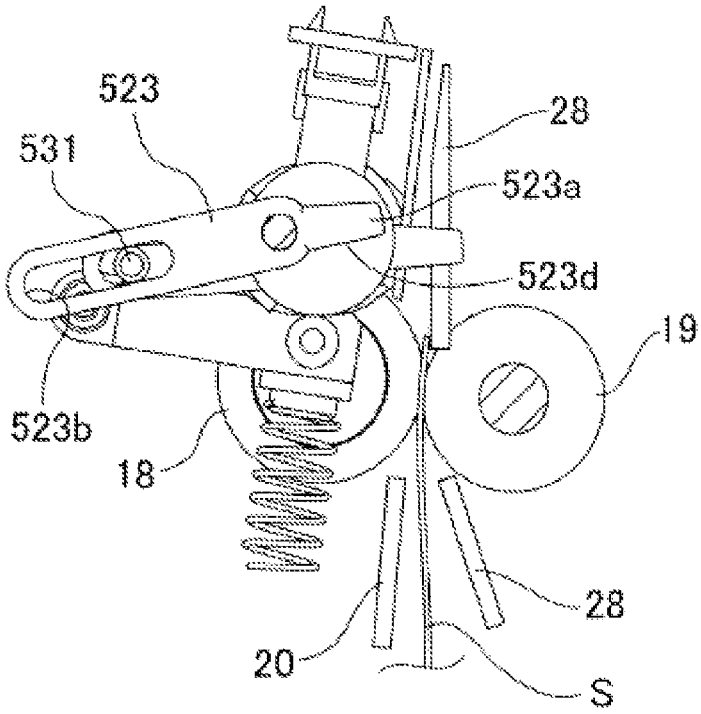
FIG. 20A is a diagram illustrating the second rotating lever in a state that the sheet is conveyed to the sheet conveying portion.
Figure 20B:
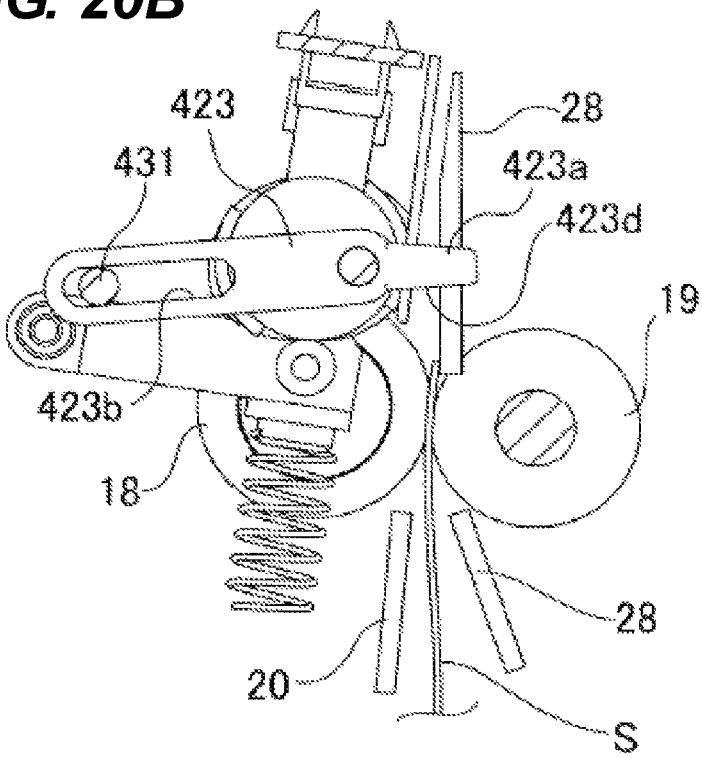
FIG. 20B is a diagram illustrating the first rotating lever in a state that the sheet is conveyed to the sheet conveying portion.
Figure 20C:
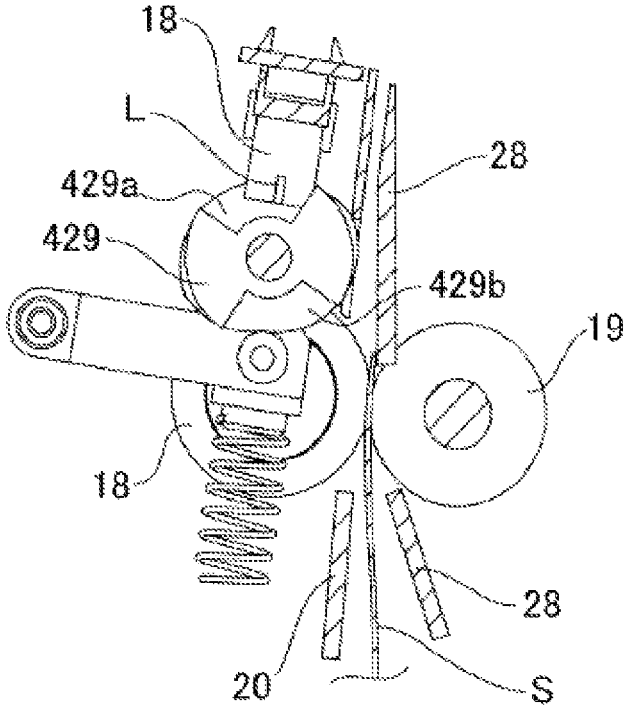
FIG. 20C is a diagram illustrating the light-shielding flag in a state that the sheet is conveyed to the sheet conveying portion.
Figure 20D:
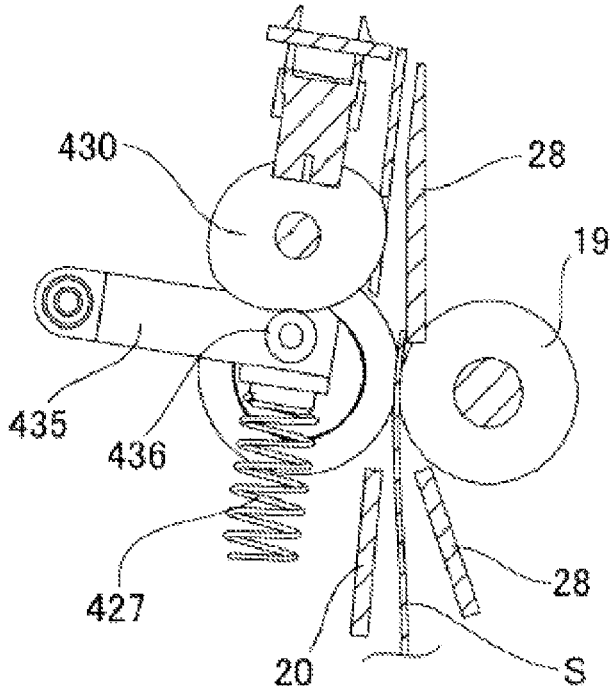
FIG. 20D is a diagram illustrating the biasing portion in a state that the sheet is conveyed to the sheet conveying portion.

First, the entire structure of the image forming apparatus 100C according to the fourth embodiment of the invention will be described with reference to FIGS. 18A to 20D along with FIG. 1. FIG. 18A is a perspective view illustrating the sheet conveying portion 9C of the image forming apparatus 100C according to the fourth embodiment of the invention. FIG. 18B is a perspective view illustrating the sheet conveying portion 9C of FIG. 18A as seen from the opposite side. FIG. 19 is an exploded perspective view illustrating a portion of the sheet detector 200C according to the fourth embodiment of the invention. FIG. 20A is a diagram illustrating the second rotating lever 523 in a state where the sheet S is conveyed to the sheet conveying portion 9C. FIG. 20B is a diagram illustrating the first rotating lever 423 in a state where the sheet S is conveyed to the sheet conveying portion 9C. FIG. 20C is a diagram illustrating the light-shielding flag 429 in a state where the sheet S is conveyed to the sheet conveying portion 9C. FIG. 20D is a diagram illustrating a biasing portion in a state where the sheet S is conveyed to the sheet conveying portion 9C.

As illustrated in FIG. 1, the image forming apparatus 100C includes the sheet feeding portion 8, the sheet conveying portion 9C conveying the sheet S while it detects the front or rear end of the sheet S fed from the sheet feeding portion 8, the image forming portion 14, the fixing portion 10, and the sheet discharge portion 13. As illustrated in FIGS. 18A and 18B, the sheet conveying portion 9C includes the paper feeding frame 20, the guide frame 28, a pair of conveying rollers 18 and 19, and the sheet detector 200C.

The sheet detector 200C includes the first rotating lever 423 as the first lever member, the second rotating lever 523 as the second lever member, the support axis 31, the rotating axes 424*a* and 426*c*, the lever driving member 426, and a pair of rotating members 425 and 424. In addition, the sheet detector 200C includes the light-shielding flag 429, the optical sensor 30, the plate cam 430 as a rotating member, the cam follower 436, the pressing member 435, and the biasing spring 427. Moreover, the biasing spring 427, the pressing member 435, and the cam follower 436 configure the biasing portion.

The first and second rotating levers 423 and 523 are similar to the rotating lever 23 according to the first embodiment so that the description thereof will not be repeated. The first and second rotating levers 423 and 523 are arranged in a symmetrical position with respect to the rotational center of the plate cam 430 so as to alternately and cyclically move to the first position. The lever driving member 426 is formed in a disk shape and fixed to the end of the rotational axis 426*c* so as to match the rotational axis 426*c* and the rotational center of the lever driving member 426. The lever driving member 426 includes the first connecting axis 426*b* of a pair of connecting portions formed to protrude to a position (eccentric position) offset radially from the rotational center.

The rotating member 424 is formed in a disk shape and is fixed to the end of the rotational axis 424*a* so as to match the rotational axis 424*a* and the rotational center of the rotating member 424. The rotating member 424 includes the second connecting axis 424*b* of a pair of connecting portions formed to protrude to a position (eccentric position) offset radially from the rotational center. The second connecting axis 424*b* is formed to penetrate the connected portion 323*c* of the first rotating lever 423.

The rotating member 425 includes the first rotating member 425*a*, the second rotating member 425*b*, and the connecting portion 425*c* which connects the first rotating member 425*a* and the second rotating member 425*b*. The first rotating member 425*a* is formed in a disk shape and includes an insertion hole through which the second connecting axis 424*b* is fitted at a position (eccentric position) offset radially from the rotational center. The second rotating member 425*b* is formed in a disk shape and includes an insertion hole through which the first connecting axis 426*b* is fitted at a position (eccentric position) offset radially from the rotational center.

The light-shielding flag 429 blocks the light path L of the optical sensor 30. The light-shielding flag 429 is fixed to the rotational axis 424*a* and is rotated integrally with a pair of rotating members 424 and 425 around the rotational axis 424*a*. That is, the light-shielding flag 429 is rotated in synchronization with the first rotating lever 423 and the second rotating lever 523. In addition, the light-shielding flag 429 includes the first and second slit portions 429*a* and 429*b* that transmit the light of the optical sensor 30. The first slit portion 429*a* is formed to transmit the light of the optical sensor 30 when the abutting surface 423*d* of the abutting portion 423*a* provided in the first rotating lever 423 is located at the first position (refer to FIGS. 20A and 20C). The second slit portion 429*b* is formed to transmit the light of the optical sensor 30 when the abutting surface 523*d* of the abutting portion 523*a* provided in the second rotating lever 523 is located at the first position (refer to FIGS. 25A and 25C described below). The light-shielding flag 429 is configured to rotate along with the first and second rotating levers 423 and 523 when the first and second rotating levers 423 and 523 are rotated by the pressing of the front end of the sheet S to alternatively block the light path L of the optical sensor 30.

The plate cam 430 is formed in an elliptical shape having two top dead points and two bottom dead points. The rotational axis 424*a* is fixed to the rotational center of the plate cam 430. Specifically, the plate cam 430 is rotated so as to be alternately located between the top dead point and the bottom dead point with respect to the rotational axis 424*a*. The cam follower 436 is mounted on the pressing member 435 and is engaged with the outer circumferential surface of the plate cam 430. The pressing member 435 is rotatably mounted on the paper feeding frame 20 in the base end, and the front end thereof is engaged with the biasing spring 427. The pressing member 435 swingably supports the cam follower 436. In other words, the pressing member 435 swings by the cam follower 436. One end of the biasing spring 427 is fixed to the paper feeding frame 20, and the other end thereof is connected to the pressing member 435. The biasing spring 427 makes the first and second rotating levers 423 and 523 locate at the first position.

Figure 21A:
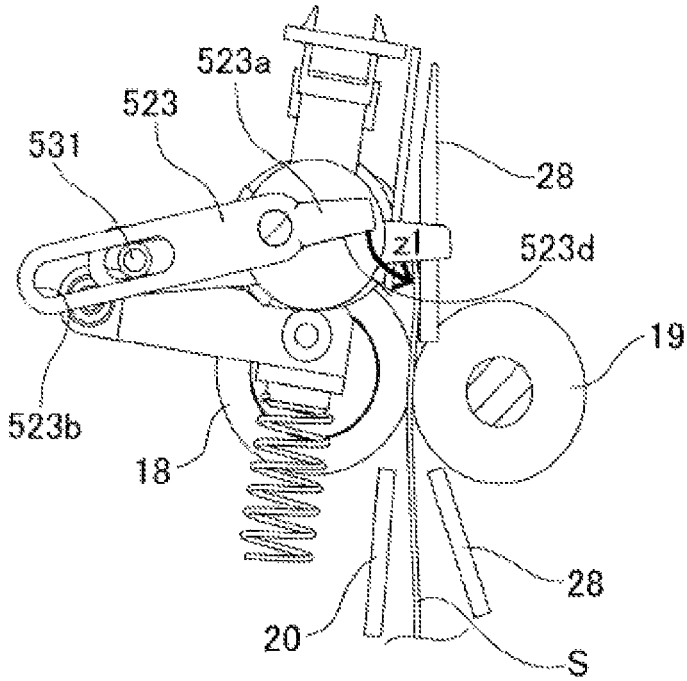
FIG. 21A is a diagram illustrating the second rotating lever in a state that the front end of the sheet abuts on the abutting surface of the first rotating lever.
Figure 21B:
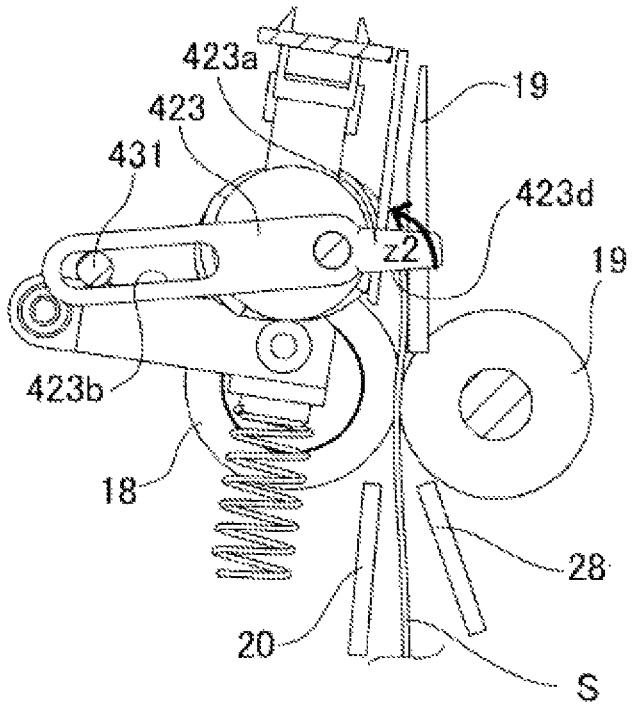
FIG. 21B is a diagram illustrating the first rotating lever in a state that the front end of the sheet abuts on the abutting surface.
Figure 21C:
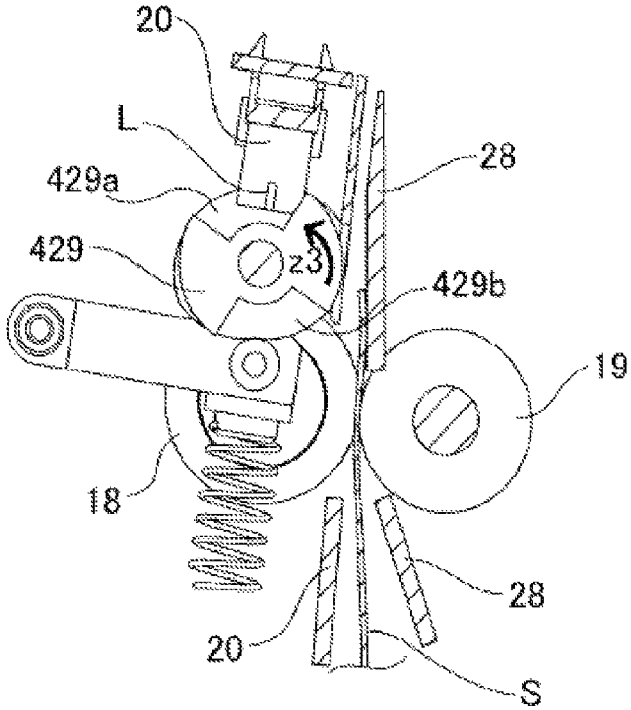
FIG. 21C is a diagram illustrating the light-shielding flag in a state that the front end of the sheet abuts on the abutting surface of the first rotating lever.
Figure 21D:
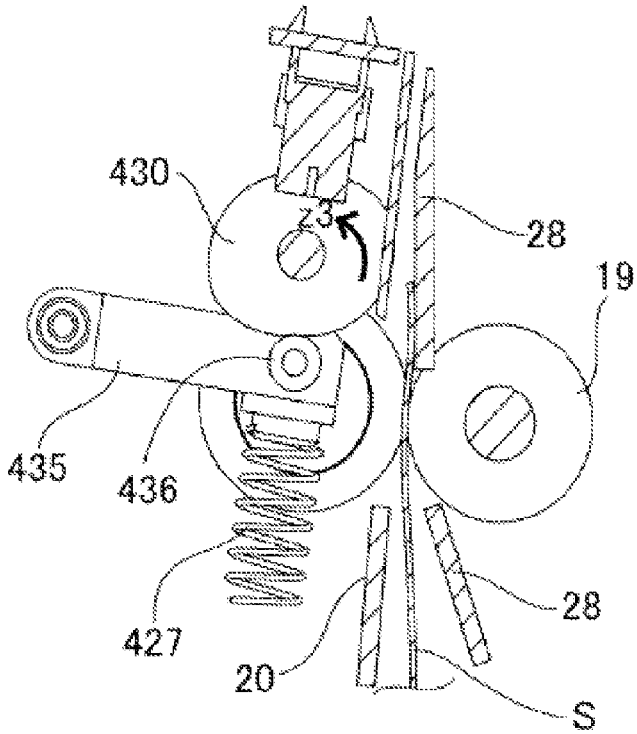
FIG. 21D is a diagram illustrating the biasing portion in a state that the front end of the sheet abuts on the abutting surface of the first rotating lever.
Figure 22A:
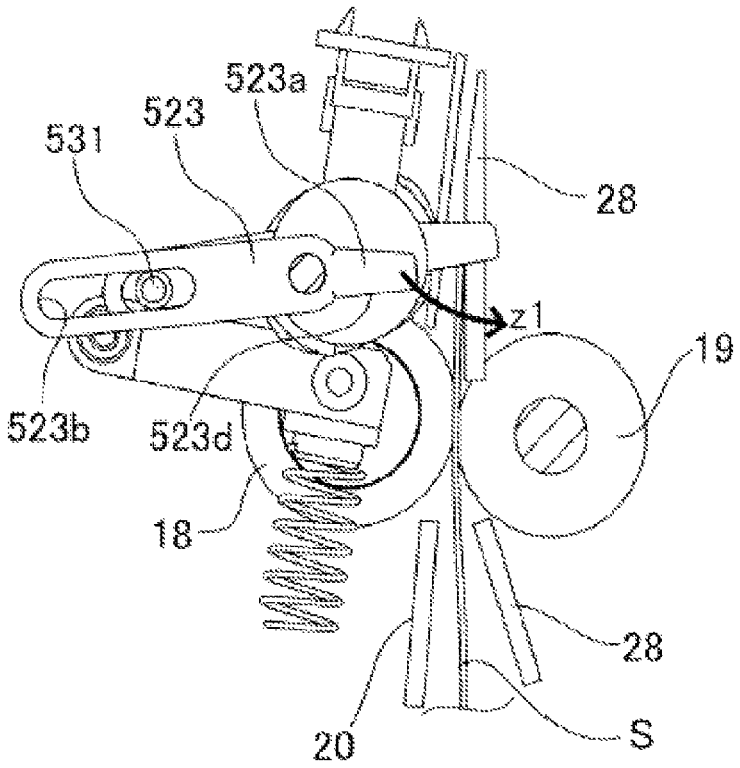
FIG. 22A is a diagram illustrating a state that the abutting surface of the first rotating lever is pressed by the front end of the sheet so that the second rotating lever is rotated along with the first rotating lever.
Figure 22B:
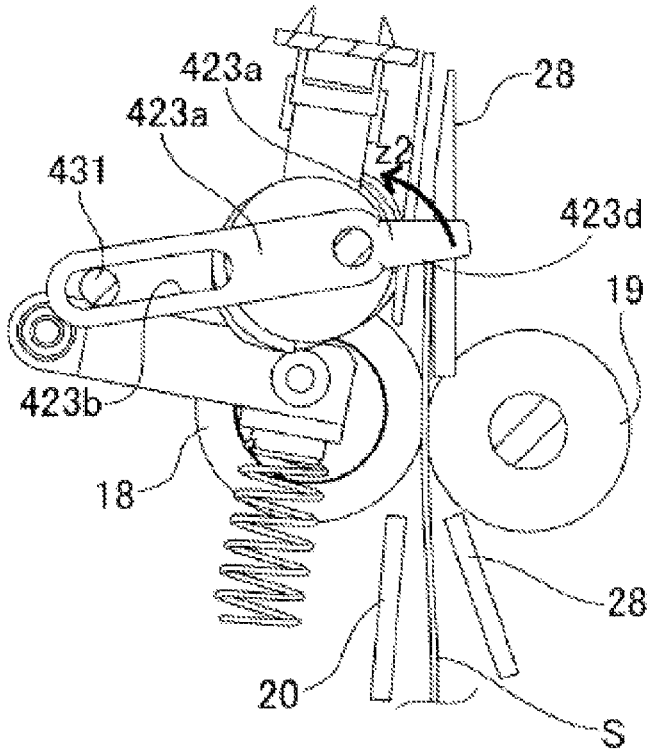
FIG. 22B is a diagram illustrating a state that the first rotating lever is rotated by the pressing of the front end of the sheet.
Figure 22C:
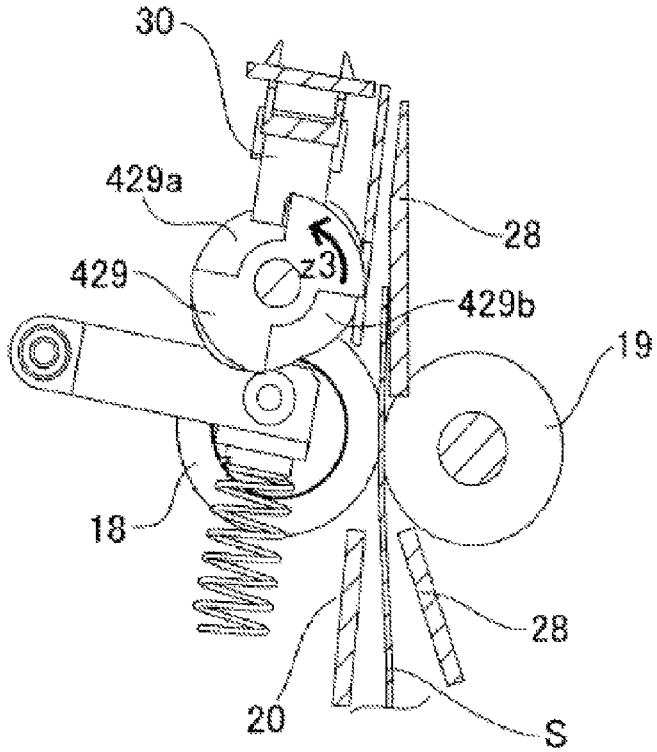
FIG. 22C is a diagram illustrating the light-shielding flag in a state that the first rotating lever is rotated by the pressing of the front end of the sheet.
Figure 22D:
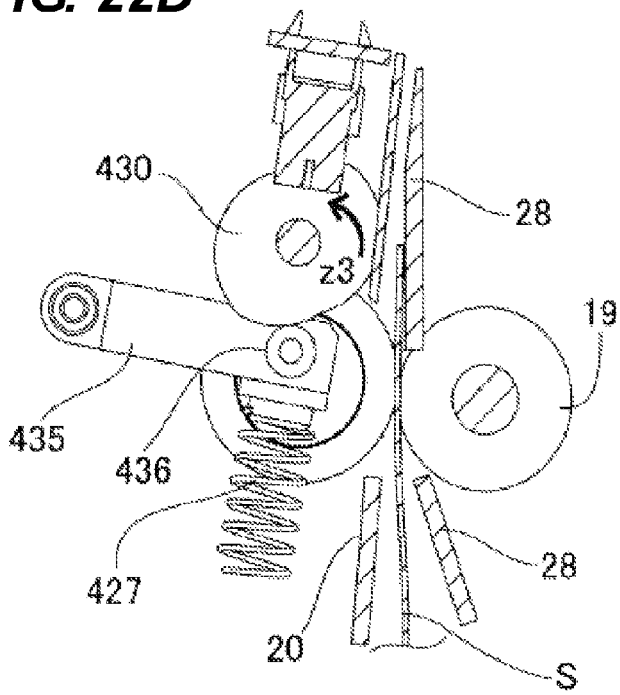
FIG. 22D is a diagram illustrating the biasing portion in a state that the first rotating lever abuts on the front end of the sheet and is rotated.

Next, the operation of the sheet detector 200C will be described with reference to FIGS. 21A to 25D along with FIGS. 20A to 20D. FIG. 21A is a diagram illustrating the second rotating lever 523 in a state where the front end of the sheet S abuts on the abutting surface 423*d* of the first rotating lever 423. FIG. 21B is a diagram illustrating the first rotating lever 423 in a state where the front end of the sheet S abuts on the abutting surface 423*d*. FIG. 21C is a diagram illustrating the light-shielding flag 429 in a state where the front end of the sheet S abuts on the abutting surface 423*d* of the first rotating lever 423. FIG. 21D is a diagram illustrating the biasing portion in a state where the front end of the sheet S abuts on the abutting surface 423*d* of the first rotating lever 423. FIG. 22A is a diagram illustrating a state in which the abutting surface 423*d* of the first rotating lever 423 is pressed by the front end of the sheet S so that the second rotating lever 523 is rotated along with the first rotating lever 423. FIG. 22B is a diagram illustrating a state in which the first rotating lever 423 is rotated by the pressing of the front end of the sheet S. FIG. 22C is a diagram illustrating the light-shielding flag 429 in a state where the first rotating lever 423 is rotated by the pressing of the front end of the sheet S. FIG. 22D is a diagram illustrating the biasing portion in a state where the front end of the sheet S abuts on the biasing portion, and the first rotating lever 423 is rotated.

Figure 23A:
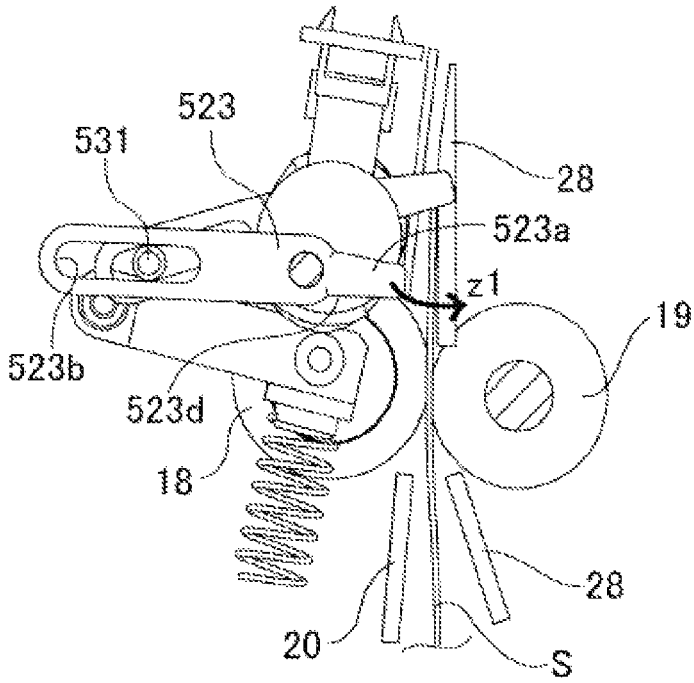
FIG. 23A is a diagram illustrating the second rotating lever in a state that the first rotating lever is rotated to the second position.
Figure 23B:
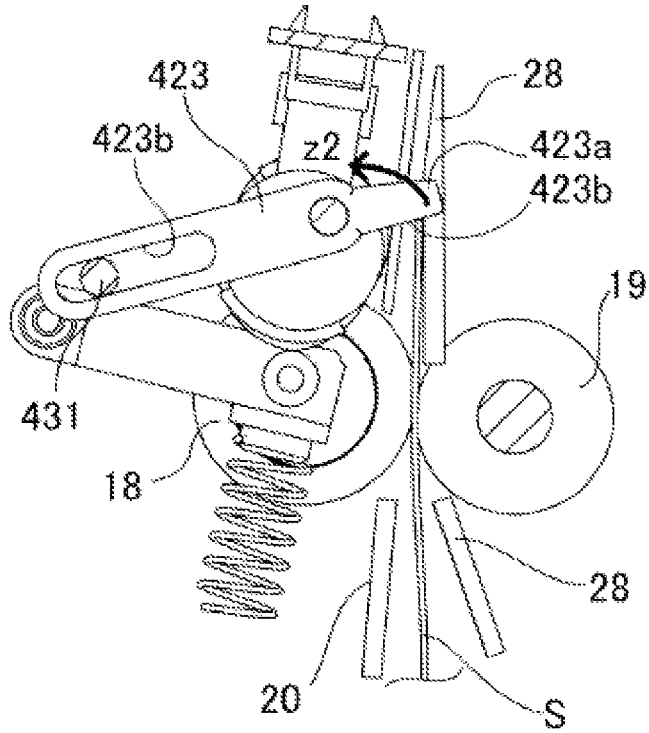
FIG. 23B is a diagram illustrating the first rotating lever rotated to the second position.
Figure 23C:
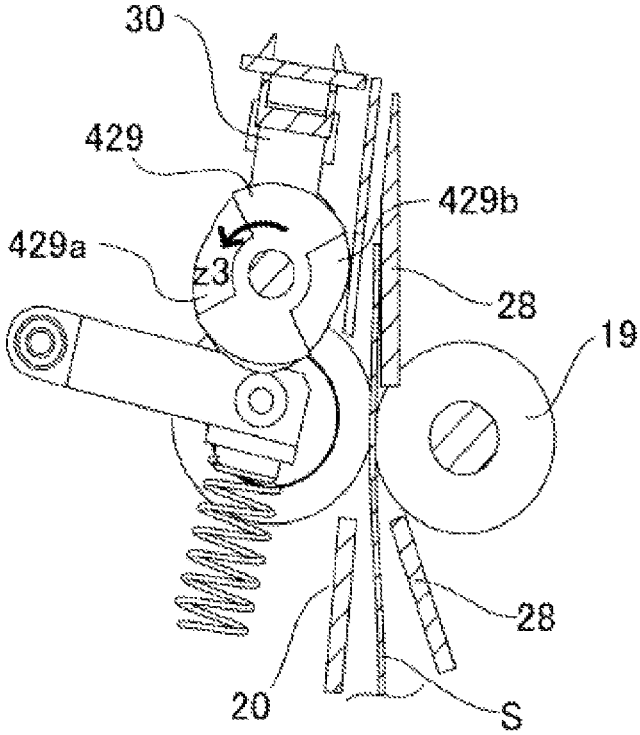
FIG. 23C is a diagram illustrating the light-shielding flag in a state that the first rotating lever is rotated to the second position.
Figure 23D:
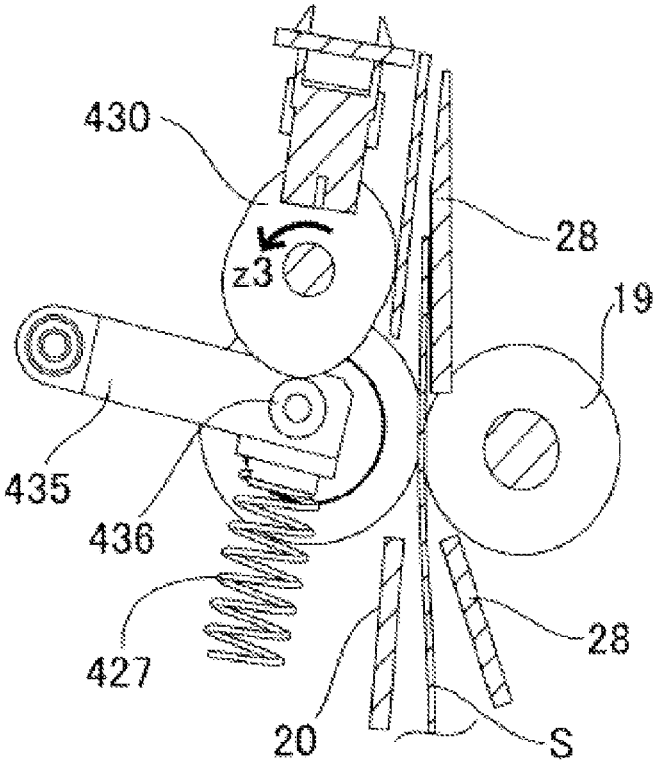
FIG. 23D is a diagram illustrating the biasing portion in a state that the first rotating lever is rotated to the second position.
Figure 24A:
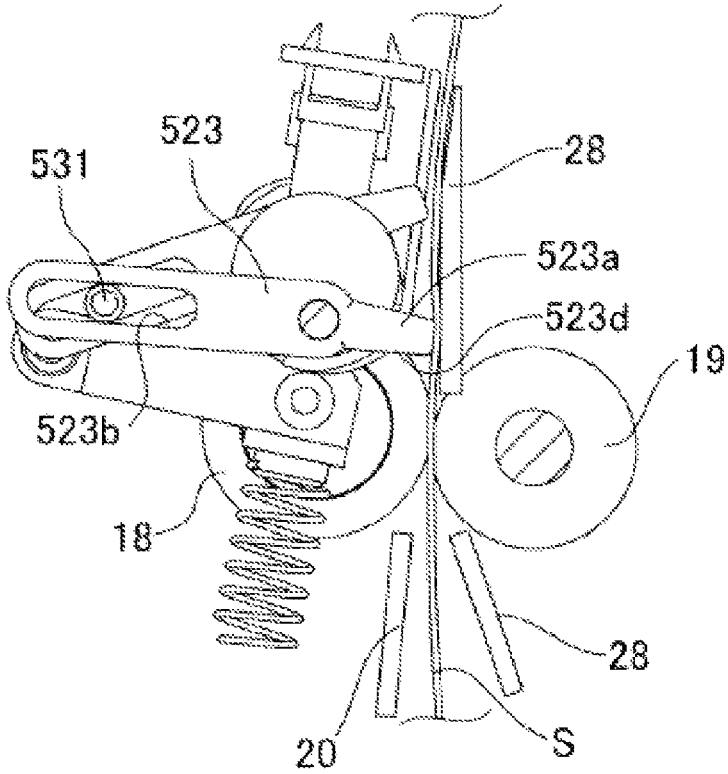
FIG. 24A is a diagram illustrating a state that the front end of the second rotating lever rotated along with the first rotating lever abuts on the front end of the conveyed sheet and waits at the third position.
Figure 24B:
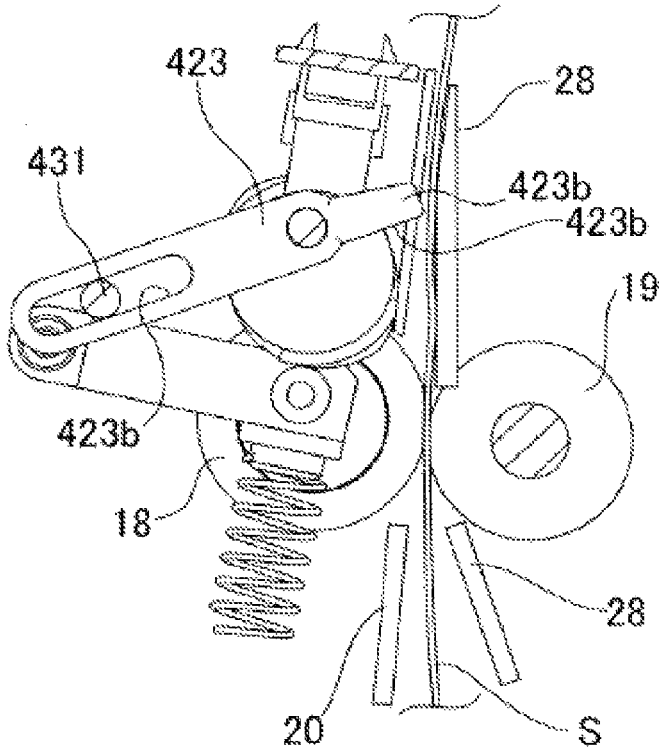
FIG. 24B is a diagram illustrating the first rotating lever in a state that the second rotating lever waits.
Figure 24C:
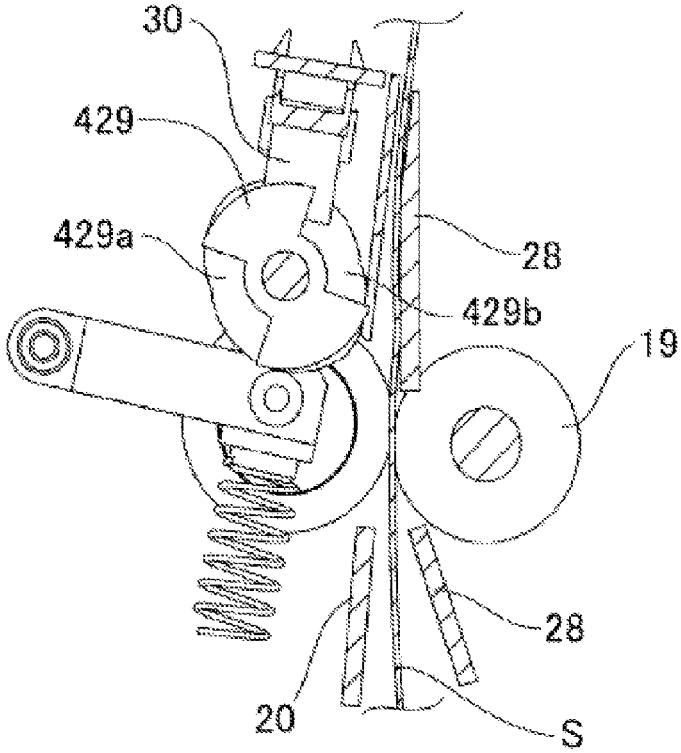
FIG. 24C is a diagram illustrating the light-shielding flag in a state that the second rotating lever waits at the third position.
Figure 24D:
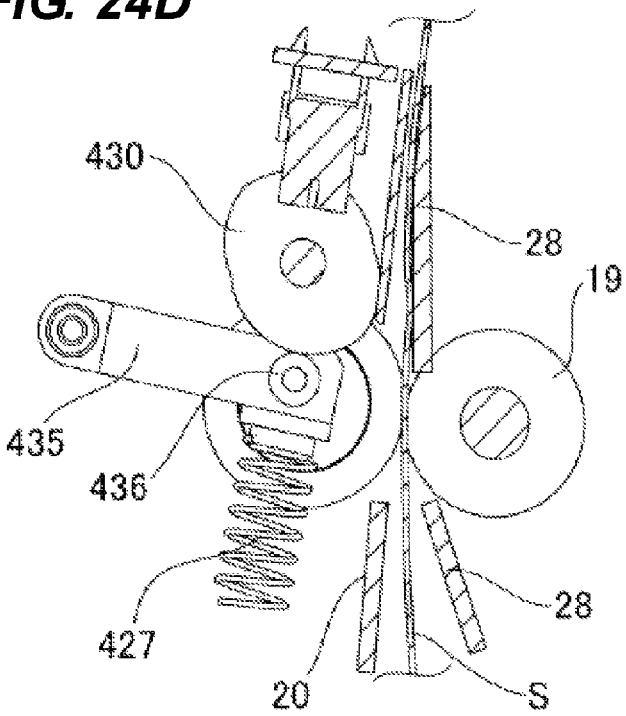
FIG. 24D is a diagram illustrating the biasing portion in a state that the second rotating lever waits at the third position.

FIG. 23A is a diagram illustrating the second rotating lever 523 in a state where the first rotating lever 423 is rotated to the second position. FIG. 23B is a diagram illustrating a state in which the first rotating lever 423 is rotated to the second position. FIG. 23C is a diagram illustrating the light-shielding flag 429 in a state where the first rotating lever 423 is rotated to the second position. FIG. 23D is a diagram illustrating the biasing portion while the first rotating lever 423 is rotated to the second position. FIG. 24A is a diagram illustrating a state in which the front end of the second rotating lever 523 rotated along with the first rotating lever 423 abuts on the front end of the conveyed sheet S and waits at the third position. FIG. 24B is a diagram illustrating the first rotating lever 423 in a state where the second rotating lever 523 waits. FIG. 24C is a diagram illustrating the light-shielding flag 429 in a state where the second rotating lever 523 waits at the third position. FIG. 24D is a diagram illustrating the biasing portion in a state where the second rotating lever 523 waits at the third position.

Figure 25A:
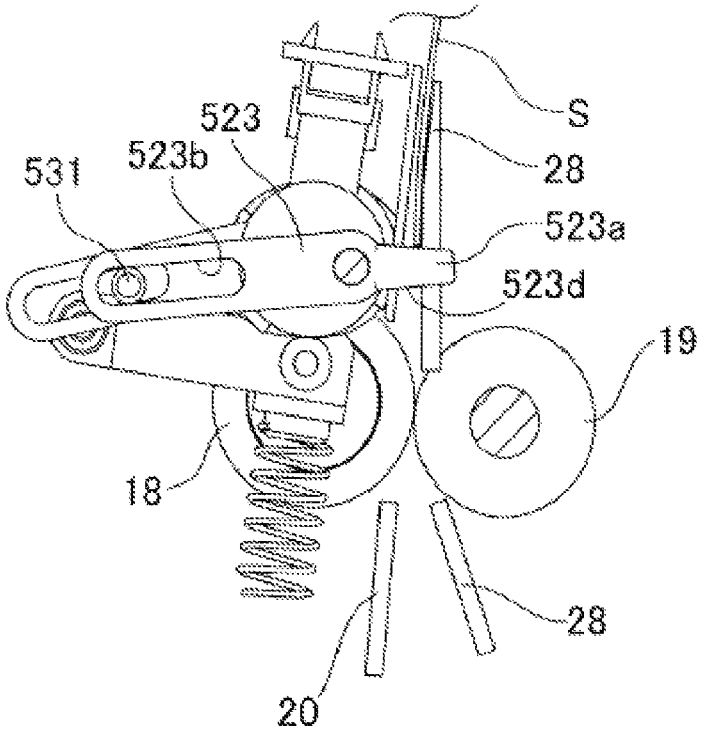
FIG. 25A is a diagram illustrating a state that the second rotating lever is rotated to the first position.
Figure 25B:
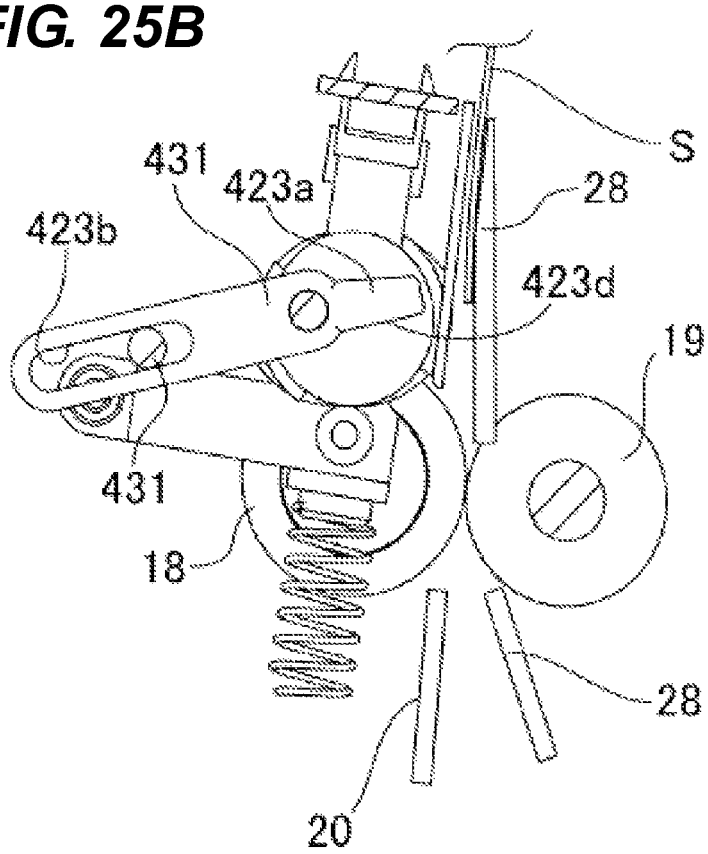
FIG. 25B is a diagram illustrating the first rotating lever in a state that the second rotating lever is rotated to the first position.
Figure 25C:
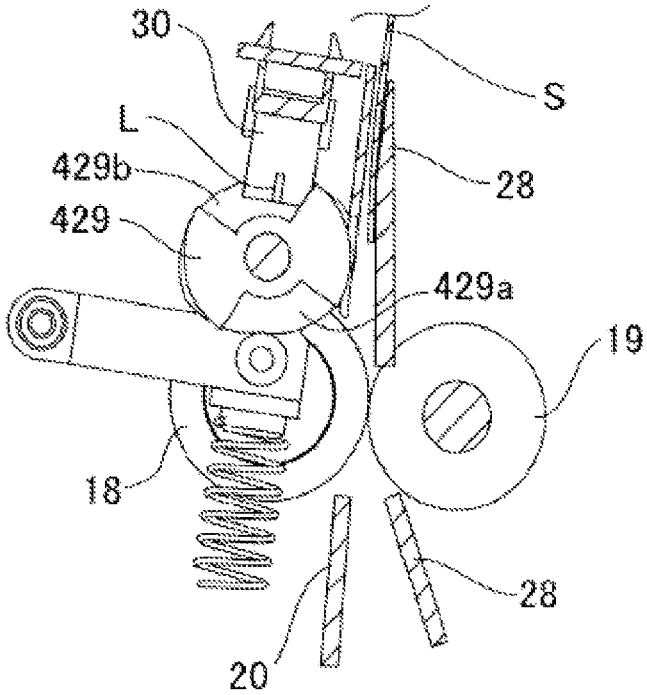
FIG. 25C is a diagram illustrating the light-shielding flag in a state that the second rotating lever is moved to the first position.
Figure 25D:
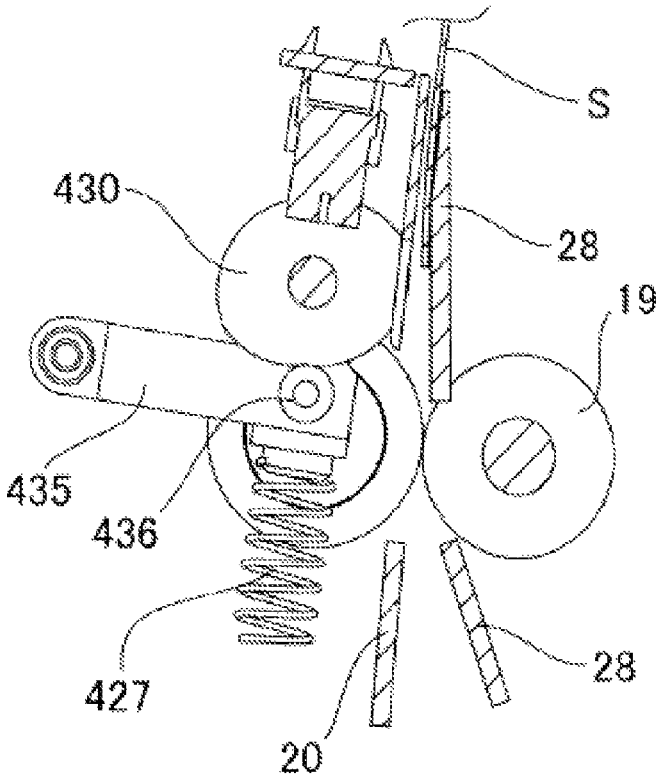
FIG. 25D is a diagram illustrating the biasing portion in a state that the second rotating lever is moved to the first position.
Figure 26:
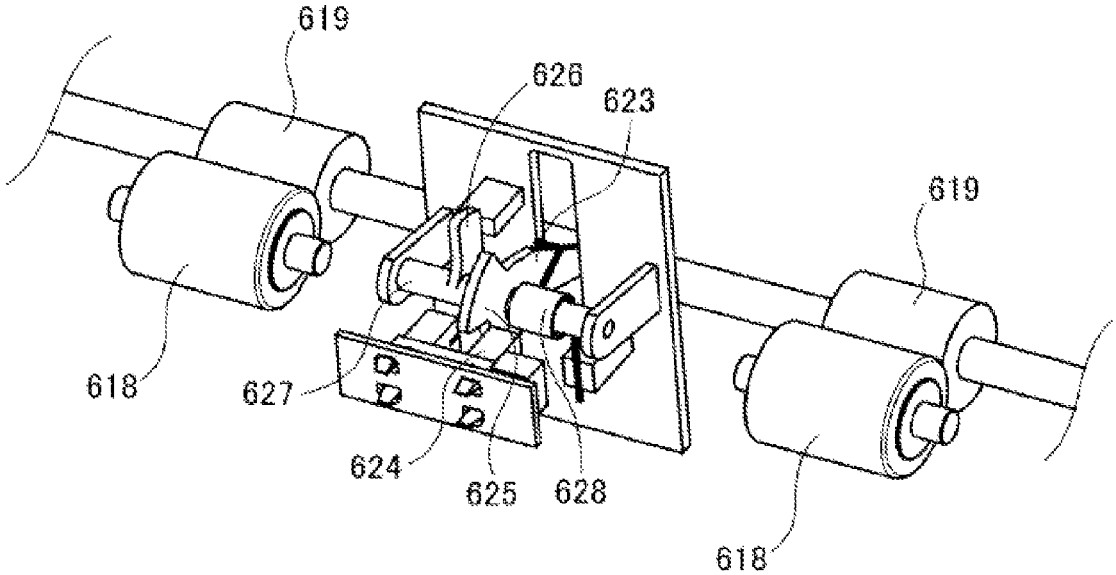
FIG. 26 PRIOR ART
FIG. 26 is a perspective diagram illustrating the sheet conveying portion of the image forming apparatus in the related art.
Figure 27A:
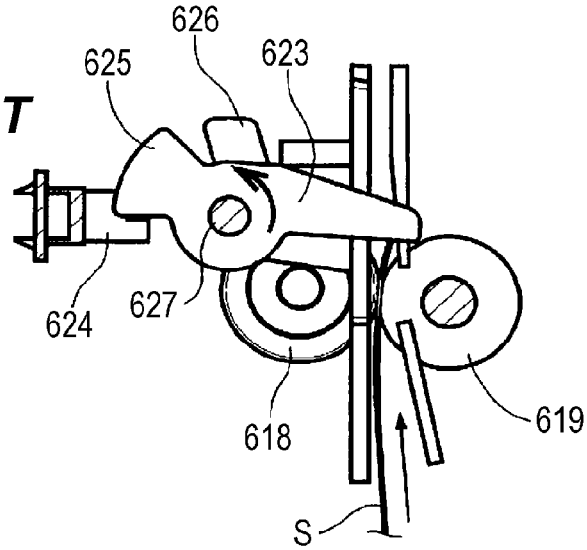
FIG. 27A PRIOR ART
FIG. 27A is a diagram illustrating a state that the front end of the sheet abuts on the light-shielding flag of the sheet detector of the sheet conveying portion in the related art.
Figure 27B:
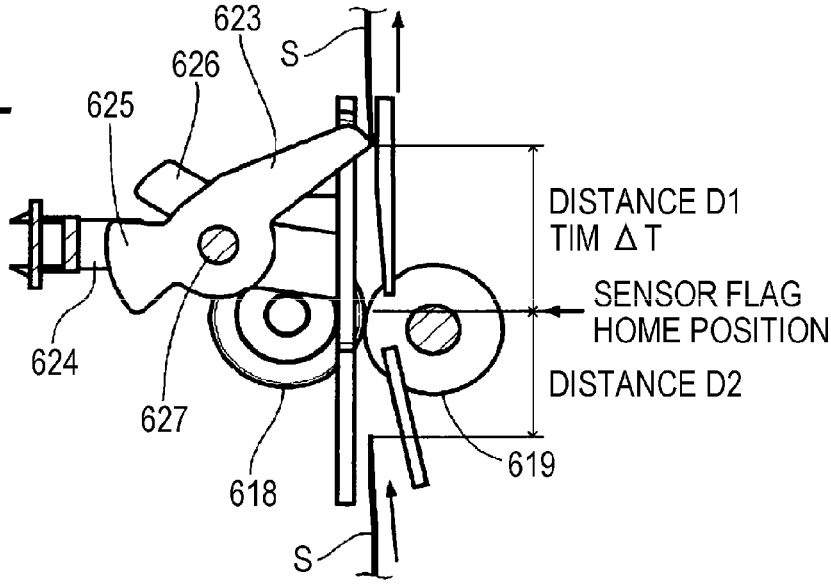
FIG. 27B PRIOR ART
FIG. 27B is a diagram illustrating the light-shielding flag in a state that it waits until the sheet passes.
Figure 27C:
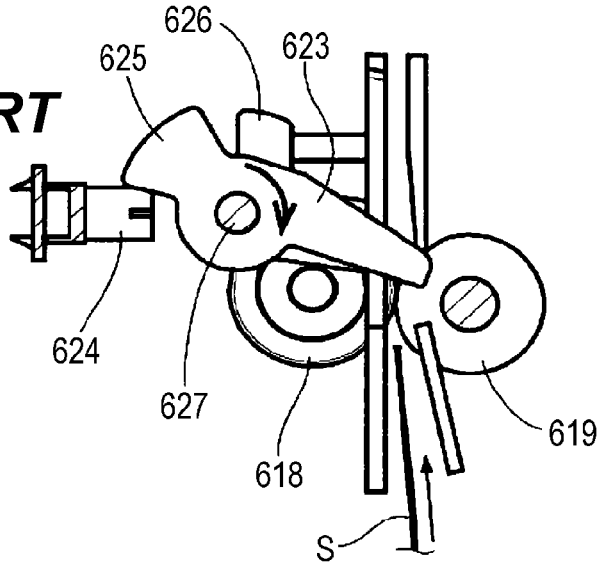
FIG. 27C PRIOR ART
FIG. 27C is a diagram illustrating a state that the sheet passes, and the light-shielding flag is returned to the home position.

FIG. 25A is a diagram illustrating a state in which the second rotating lever 523 is rotated to the first position. FIG. 25B is a diagram illustrating the first rotating lever 423 in a state where the second rotating lever 523 is rotated to the first position. FIG. 25C is a diagram illustrating the light-shielding flag 429 in a state where the second rotating lever 523 is moved to the first position. FIG. 25D is a diagram illustrating the biasing portion in a state where the second rotating lever 523 is moved to the first position.

As illustrated in FIGS. 20A and 20B, the abutting portion 423*a* of the first rotating lever 423 is held at first position in a standby state by virtue of a holding force of the biasing spring 427 while the front end of the sheet S does not abut on the abutting surface 423*d* of the first rotating lever 423. In addition, when the first rotating lever 423 waits at the first position, the second rotating lever 523 waits at the position that the abutting surface 523*d* is retracted from the sheet conveying path 15*a*. At this time, as illustrated in FIG. 20C, the light path L of the optical sensor 30 is not blocked by the first slit portion 429*a* of the light-shielding flag 429. Moreover, as illustrated in FIG. 20D, the plate cam 430 is positioned such that the bottom dead point of the one end is engaged with the cam follower 436, and the biasing spring 427 holds the plate cam 430 at the first position through the cam follower 436 and the pressing member 435.

Next, as illustrated in FIGS. 21A and 21B, as the front end of the sheet S conveyed by a pair of conveying rollers 18 and 19 abuts on the abutting surface 423*d* of the first rotating lever 423, the sheet S presses the abutting surface 423*d* against the holding force of the biasing spring 427 in order to hold the plate cam 430 through the pressing member 435 and the cam follower 436. If the abutting surface 423*d* is pressed by the sheet S, the plate cam 430 is rotated in the z3 direction of FIG. 21D, and the outer circumferential surface of the plate cam 430 presses the biasing spring 427 through the cam follower 436 and the pressing member 435. At this time, the light-shielding flag 429 is also rotated in the arrow direction z3 of FIG. 21C. In addition, as the abutting surface 423*d* is pressed by the sheet S, the first rotating lever 423 is rotated. As the first rotating lever 423 is rotated, the abutting surface 423*d* moves in the z2 direction of FIG. 21B, the second rotating lever 523 is rotated, and the abutting surface 523*d* moves in the arrow direction z1 of FIG. 21A.

At this time, the front end of the sheet S includes the paper feeding frame 20 and the guide frame 28 and is guided by the sheet-passing guide arranged on the downstream side in the sheet conveying direction of a pair of conveying rollers 18 and 19 as illustrated in FIG. 21C. For this reason, it is possible to prevent the front end of the sheet S from being separated from the abutting surface 423*d*. Further, it is possible to rotate the abutting surface 423*d* of the first rotating lever 423 while being reliably pressed by the front end of the sheet S.

Subsequently, as illustrated in FIGS. 22A and 22B, the first rotating lever 423 is further rotated in the z2 direction. Then, the light-shielding flag 429 illustrated in FIG. 22C is rotated in the z3 direction to block the light path L of the optical sensor 30 so as to synchronize with the arrival of the plate cam 430 illustrated in FIG. 22D at the second position. As the first rotating lever 423 is further rotated and arrives at the top dead point (the second position) of the plate cam 430 where the biasing spring 427 is biased at maximum as illustrated in FIG. 23D, the first rotating lever 423 arrives at the second position as illustrated in FIG. 23B. At the same time, as illustrated in FIG. 23A, movement to the arrow z1 direction is initiated such that the abutting surface 523*d* of the second rotating lever 523 is located in the sheet conveying path 15*a*. As a result, as illustrated in FIG. 23C, the light path L of the optical sensor 30 is blocked by the light-shielding flag 429. If the light path L of the optical sensor 30 is blocked, the sheet detector 200C detects that the first rotating lever 423 is rotated to a predetermined rotating position, and the front end of the sheet S is conveyed to a desired position. In addition, a predetermined signal is transmitted to the image forming portion 14, and the image forming portion 14 initiates formation of the toner image as the image forming portion 14 receives the signal.

As illustrated in FIGS. 24A, 24C, and 24D, as the first rotating lever 423 arrives at the second position, the force for rotating the plate cam 430 is switched to the biasing force for retracting the abutting surface 423*d* of the first rotating lever 423 from the sheet conveying path 15*a*. Similarly, the force for rotating the plate cam 430 is switched to the biasing force for positioning the abutting surface 523*d* of the second rotating lever 523 to the first position.

Here, although the second rotating lever 523 receives the biasing force of the biasing spring 427 and is rotated to the first position, the sheet S is conveyed by a pair of conveying rollers 18 and 19 at this timing (while the sheet S passes through the first position in the sheet conveying path 15*a*). Therefore, the second rotating lever 523 waits at the third position where the front end of the abutting portion 523*a* abuts on the surface (or rear surface) of the sheet S while it is biased by the biasing spring 427 as illustrated in FIG. 24A. In addition, as illustrated in FIG. 24C, the light path L of the optical sensor 30 is blocked by the light-shielding flag 429 even in this state.

Moreover, as the rear end of the sheet S passes through the front end of the abutting portion 523*a*, the second rotating lever 523 initiates rotation so that the abutting portion 523*a* is located at the first position by the biasing force of the biasing spring 427 as illustrated in FIG. 25A. Furthermore, as the rear end of the sheet S recedes from the abutting portion 523*a*, in the second rotating lever 523, the abutting portion 523*a* protrudes to the sheet conveying path 15*a*, and the abutting surface 523*d* waits at the first position where the abutting surface 523*d* can abut on the front end of the subsequent sheet S. At this time, in the light path L of the optical sensor 30, the light blocking by the light-shielding flag 429 is released, and the optical sensor 30 generates a transmission signal as illustrated in FIG. 25C. As a result, it is possible to detect that the sheet S passes. In addition, as illustrated in FIG. 25D, since the bottom dead point of the other end of the plate cam 430 is engaged with the cam follower 436, the biasing spring 427 holds the plate cam 430 at the first position through the cam follower 436 and the pressing member 435. For this reason, the second rotating lever 523 is held at the first position. Similarly, as illustrated in FIG. 25B, the first rotating lever 423 is held in a retracted state from the sheet conveying path 15*a*.

In the image forming apparatus 100C according to the fourth embodiment having the configuration described above, it is possible to obtain the following effects in addition to the effects of the first embodiment. The sheet detector 200C according to the fourth embodiment uses the plate cam as the rotating member and includes the pressing member 435, the cam follower 436, and the biasing spring 427 as the biasing member. For this reason, for example, it is possible to improve the position accuracy in a state where the rotating lever stops at the first position.

In addition, the sheet detector 200C according to the fourth embodiment includes the first rotating lever 423 and the second rotating lever 523. Using a plurality of rotating levers in this manner, for example, it is possible to suppress the scraping generated when sheet S passes through the rotating lever.

While the invention has been particularly shown and described with reference to exemplary embodiments thereof, it is noted that the invention is not limited to the above-described embodiments. The effects described in the embodiment of the invention are merely listed the most suitable effects resulting from the invention, and the effect of the invention is not limited to those described in the embodiment of the invention.

For example, in the first embodiment, although formation of the toner image (image forming process) is initiated in the image forming portion 14 when the sheet detector 200 detects that the front end of the sheet S is conveyed to a desired position, the invention is not limited thereto. The image forming apparatus 100 may form the toner image (image forming process) using the image forming portion 14 in advance, and the image may be transferred to the transfer rollers 5*a* to 5*d* at the timing when the sheet S arrives at the transfer rollers 5*a* to 5*d* if sheet S is detected by the sheet detector 200.

Moreover, for example, in the present embodiment, although the biasing spring 27 makes the rotating lever wait at the first position, the invention is not limited thereto. For example, by controlling the weight balance of the rotating lever, the abutting surface of the rotating lever may wait at the first position using the weight. In addition, an elastic force of a plate spring, rubber, and the like may be used.

In the third embodiment, although the linking gear 333 is used as the linking member, the invention is not limited thereto. For example, the linking member may be a timing belt, a timing chain, and the like. The linking member may rotate the first and second rotating members in the same direction at the same phase.

Furthermore, for example, in the present embodiment, although the sheet conveying portion 9 (sheet detector 200) is provided on the upstream side of the image forming portion 14, the invention is not limited thereto. For example, the sheet conveying portion 9 (sheet detector 200) may be provided on the downstream side of the fixing portion 10. For example, if the sheet detector 200A according to the second embodiment is provided in the downstream side of the fixing portion 10, the sheet detector 200A waits in rolling contact with the surface of the sheet S where the toner image has been formed after the fixing. Therefore, it is possible to suppress a damage of the fixed toner image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-004918, filed Jan. 13, 2011, which is hereby incorporated by reference herein in its entirety.

What is claimed is:

1. A sheet detecting apparatus that detects a sheet conveyed by a conveying portion that conveys the sheet, the sheet detecting apparatus comprising:

a lever member having an abutting surface that abuts against a leading end of a sheet conveyed by the conveying portion;

a biasing portion that applies a biasing force to the lever member to position the lever member at a first position where the abutting surface abuts against the leading end of the sheet;

a supporting mechanism that movably supports the lever member so that the lever member moves in an order of the first position, a second position, and a third position, while keeping the abutting surface facing upstream in a sheet conveying direction, wherein the second position is a position to which the lever member moves by the sheet being conveyed against the biasing force of the biasing member, and the third position is a position where the abutting surface is positioned upstream in the sheet conveying direction of a position of the abutting surface at the second position and where the lever member abuts the surface of the sheet being conveyed and stands by to move to the first position when a trailing end of the sheet passes the lever member; and a detector that detects a position of the lever member.

2. The sheet detecting apparatus according to claim 1, wherein the support mechanism includes a slide supporting portion that slidably supports the lever member, and a rotating member that rotatably supports the lever member at a connection portion, the connection portion being displaced from a rotation center of the rotating member.

3. The sheet detecting apparatus according to claim 1, wherein the lever member includes an abutting portion provided with the abutting surface, and a main portion which is integrated with the abutting portion and has a long hole portion, the supporting mechanism includes: a support axis slidably engaged with the long hole portion; and a rotating member rotatably connected to the main portion in a connecting portion displaced from a rotational center of the rotating member, and the abutting portion performs an approximate elliptical movement by unidirectional rotation of the rotating member.

4. The sheet detecting apparatus according to claim 2, wherein the biasing portion includes a biasing member having one end fixedly positioned and the other end connected to the rotating member.

5. The sheet detecting apparatus according to claim 2, wherein the rotating member is a cam where the second position is a top dead point and the first position is a bottom dead point, and the biasing portion includes a cam follower formed to make contact with the cam swingably and a biasing member having one end fixedly positioned and the other end connected to the cam follower.

6. The sheet detecting apparatus according to claim 5, wherein the cam is formed in an elliptical shape having two top dead points and two bottom dead points, and the lever member includes a first lever member and a second lever member, and the first and second lever members are rotatably connected to the cam in a pair of connecting portions provided on symmetrical positions with respect to a rotational center the cam so as to alternately and cyclically move to the first position.

7. The sheet detecting apparatus according to claim 2, further comprising an interlocking portion that interlocks with the lever member and is detected by the detector for detecting the position of the lever member, wherein the interlocking portion is fixed to a rotational axis of the rotating member and is rotated in synchronization with a movement of the abutting surface of the lever member.

8. The sheet detecting apparatus according to claim 1, wherein the lever member includes an abutting portion having an abutting surface and a main portion which is integrated with the abutting portion and has first and second connected portions, the supporting mechanism includes a first rotating member rotatably connected to the first connected portion of the main portion in a first connecting portion displaced from a rotational center of the first rotating member, a second rotating member rotatably connected to the second connected portion of the main portion in a second connecting portion displaced from a rotational center of the second rotating member, and a linking member that links the first and second rotating members so that the first and second rotating members rotate in the same direction at the same phase, and the abutting portion performs a circular movement by unidirectional rotation of the first rotating member.

9. The sheet detecting apparatus according to claim 8, wherein the biasing portion includes a biasing member having one end fixedly positioned and the other end connected to the first rotating member.

10. The sheet detecting apparatus according to claim 1, wherein a front end of the lever member is provided with a follower roller that can be rotated in contact with the conveyed sheet.

11. An image forming apparatus comprising:

a conveying portion which conveys the sheet in a sheet conveying path;

a lever member having an abutting surface that abuts against a leading end of a sheet conveyed by the conveying portion;

a biasing portion that applies a biasing force to the lever member to position the lever member at a first position where the abutting surface abuts against the leading end of the sheet;

a supporting mechanism that movably supports the lever member so that the lever member moves in an order of the first position, a second position, a third position, while keeping the abutting surface facing upstream in a sheet conveying direction, wherein the second position is a position to which the lever member moves by the sheet being conveyed against the biasing force of the biasing member, and the third position is a position where the abutting surface is positioned upstream in the sheet conveying direction of a position of the abutting surface at the second position and where the lever member abuts the surface of the sheet being conveyed and stands by to move to the first position when a trailing end of the sheet passes the lever member;

a detector that detects a position of the lever member interlocking portion; and an image forming portion which forms an image on the conveyed sheet.

12. A sheet detecting apparatus that detects a sheet conveyed by a conveying portion that conveys the sheet, the sheet detecting apparatus comprising:

a lever member having an abutting surface that abuts against a leading end of a sheet conveyed by the conveying portion;

a biasing portion that applies a biasing force to the lever member to position the lever member at a first position where the abutting surface abuts against the leading end of the sheet;

a support mechanism that movably supports the lever member so that the lever member performs a crank-movement; and a detector that detects a position of the lever member.

13. The sheet detecting apparatus according to claim 12, wherein the support mechanism includes a rotating member that rotatably supports the lever member at a connection portion, the connection portion being displaced from a rotation center of the rotating member.

14. The sheet detecting apparatus according to claim 13, wherein the support mechanism further includes a slide supporting portion that slidably supports the lever member.

15. The sheet detecting apparatus according to claim 13, wherein the lever member includes an abutting portion provided with the abutting surface, and a main portion which is integrated with the abutting portion and has a long hole portion, the supporting mechanism includes a support axis slidably engaged with the long hole portion, and the abutting portion performs an approximate elliptical movement by unidirectional rotation of the rotating member.

16. The sheet detecting apparatus according to claim 13, wherein the biasing portion includes a biasing member having one end fixedly positioned and the other end connected to the rotating member.

17. The sheet detecting apparatus according to claim 13, wherein the rotating member is a cam where the second position is a top dead point and the first position is a bottom dead point, and the biasing portion includes a cam follower formed to make contact with the cam swingably and a biasing member having one end fixedly positioned and the other end connected to the cam follower.

18. The sheet detecting apparatus according to claim 17, wherein the cam is formed in an elliptical shape having two top dead points and two bottom dead points, and the lever member includes a first lever member and a second lever member, and the first and second lever members are rotatably connected to the cam in a pair of connecting portions provided on symmetrical positions with respect to a rotational center of the cam so as to alternately and cyclically move to the first position.

19. The sheet detecting apparatus according to claim 12, further comprising an interlocking portion that interlock with the lever member and is detected by the detector for detecting the position of the lever member, wherein the interlocking portion is fixed to a rotational axis of the rotating member and is rotated in synchronization with a movement of the abutting surface of the lever member.

20. The sheet detecting apparatus according to claim 13, wherein the lever member includes an abutting portion having an abutting surface and a main portion which is integrated with the abutting portion and has first and second connected portions, the supporting mechanism further includes a second rotating member rotatably connected to the second connected portion of the main portion in a second connecting portion displaced a rotational center of the second rotating member, and a linking member that links the first and second rotating members so that the first and second rotating members rotate in the same direction at the same phase, and the abutting portion performs a circular movement by unidirectional rotation of the first rotating member.

21. The sheet detecting apparatus according to claim 20, wherein the biasing portion includes a biasing member having one end fixedly positioned and the other end connected to the rotating member.

22. The sheet detecting apparatus according to claim 12, wherein a front end of the lever member is provided with a follower roller that can be rotated in contact with the conveyed sheet.

* * * * *